US011321975B2

(12) United States Patent
Mizuno et al.

(10) Patent No.: US 11,321,975 B2
(45) Date of Patent: May 3, 2022

(54) ONBOARD APPARATUS, INFORMATION PROCESSING APPARATUS, AND INFORMATION PROCESSING METHOD

(71) Applicant: TOYOTA JIDOSHA KABUSHIKI KAISHA, Toyota (JP)

(72) Inventors: Yuko Mizuno, Nagoya (JP); Kazuhiko Nakanishi, Kariya (JP); Masayuki Matsuda, Seto (JP); Satoshi Shimada, Chiryu (JP); Takuya Maekawa, Nisshin (JP); Yorichika Ishiyama, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 340 days.

(21) Appl. No.: 16/502,588

(22) Filed: Jul. 3, 2019

(65) Prior Publication Data

US 2020/0027291 A1 Jan. 23, 2020

(30) Foreign Application Priority Data

Jul. 18, 2018 (JP) ..... JP2018-135016

(51) Int. Cl.

| | |
|---|---|
| ***G07C 5/08*** | (2006.01) |
| ***G06Q 50/30*** | (2012.01) |
| ***G07C 5/02*** | (2006.01) |

(52) U.S. Cl.

CPC ..... *G07C 5/0841* (2013.01); *G06Q 50/30* (2013.01); *G07C 5/02* (2013.01)

(58) Field of Classification Search

CPC ..... G07C 5/0841; G07C 5/02; G06Q 50/30
USPC ..... 701/33.4
See application file for complete search history.

(56) References Cited

U.S. PATENT DOCUMENTS

| | | | | |
|---|---|---|---|---|
| 9,805,601 | B1 * | 10/2017 | Fields | H04W 4/44 |
| 2010/0185359 | A1 | 7/2010 | Tauchi et al. | |
| 2014/0051041 | A1 | 2/2014 | Stefan et al. | |

FOREIGN PATENT DOCUMENTS

| | | | |
|---|---|---|---|
| CN | 103593886 | A | 2/2014 |
| GN | 101896950 | A | 11/2010 |
| JP | S59-084668 | U | 6/1984 |
| JP | 2010-079469 | A | 4/2010 |

* cited by examiner

*Primary Examiner* — Gertrude Arthur Jeanglaude
(74) *Attorney, Agent, or Firm* — Oliff PLC

(57) ABSTRACT

An onboard apparatus comprises a communication unit; and a controller configured to execute: detecting start of running of a vehicle provided for sharing a ride, detecting a driver at the start of running, detecting change of the driver after the start of running and measuring passage information including at least one of running time and running distance from the start of running until the change of the driver, and transmitting the measured passage information to an information processing apparatus via the communication unit along with identification information for identifying the driver detected before the change of the driver.

7 Claims, 18 Drawing Sheets

| RESERVA-TION ID | PLANNED DRIVER ID | VEHICLE NUMBER | DESTI-NATION | FELLOW-PASSENGER ID | PLANNED RIDING POINT | PLANNED RIDING DATE AND TIME | PLANNED ALIGHTING POINT | PLANNED ALIGHTING DATE AND TIME |
|---|---|---|---|---|---|---|---|---|
| ... | ... | ... | ... | ... | ... | ... | ... | ... |
| S002 | D002 | ... | e | P001 | f | 2018/07/06/09:10 | g | 2018/07/06/09:40 |
| | | | | P002 | h | 2018/07/06/09:20 | e | 2018/07/06/10:00 |
| ... | ... | ... | ... | ... | ... | ... | ... | ... |

FIG. 5

| RESER-VATION ID | OWNER ID | SECTION | PERSONS ON BOARD | POSITIONAL INFORMATION HISTORY |
|---|---|---|---|---|
| S002 | D002 | d－f | D002 | X0001 |
| | | f－h | D002、P001 | X0002 |
| | | h－g | D002、P001、P002 | X0003 |
| | | g－e | D002、P002 | X0004 |

FIG. 6

| RESER-VATION ID | PERSONS ON BOARD | OWNER POINT | DRIVING POINT | | TOTAL POINT |
|---|---|---|---|---|---|
| | | | RUNNING DISTANCE | RUNNING TIME | |
| S002 | D002 | P5 | P2 | P4 | (P5or0) +MAX {P2, P4} |
| | P001 | 0 | P2 | P4 | (P5or0) +MAX {P2, P4} |
| | P002 | 0 | P2 | P4 | (P5or0) +MAX {P2, P4} |

FIG. 7

ONBOARD APPARATUS, INFORMATION PROCESSING APPARATUS, AND INFORMATION PROCESSING METHOD

CROSS REFERENCE TO THE RELATED APPLICATION

This application claims the benefit of Japanese Patent Application No. 2018-135016, filed on Jul. 18, 2018, which is hereby incorporated by reference herein in its entirety.

BACKGROUND

Technical Field

The present disclosure relates to an onboard apparatus, an information processing apparatus, and an information processing method for supporting ridesharing.

Description of the Related Art

Recently, a transportation mode called ridesharing in which a plurality of users share a ride on the same vehicle has been gaining popularity. Disclosed in Japanese Patent Laid-Open No. 2010-079469 is a technique to add value to such service according to the number of people in a group sharing a ride.

SUMMARY

With the background technique mentioned above, however, there is no consideration on actual driving records of each driver of vehicles used for ridesharing.

It is an object of the present disclosure to provide a technique that evaluates the actual driving records of the drivers for ridesharing when there is change of the driver.

An aspect of the present disclosure is exemplified as an onboard apparatus. The onboard apparatus comprises a communication unit; and a controller configured to execute detecting start of running of a vehicle provided for sharing a ride, detecting a driver at the start of running, detecting change of the driver after the start of running and measuring passage information including at least one of running time and running distance from the start of running until the change of the driver, and transmitting the measured passage information to an information processing apparatus via the communication unit along with identification information for identifying the driver detected before the change of the driver.

Further, another aspect of the present disclosure is exemplified as an information processing apparatus. The information processing apparatus comprises a communication unit; and a controller configured to execute, via the communication unit, receiving identification information for identifying each of drivers recorded between start of running of a vehicle by sharing a ride to end and passage information recorded for each of the drivers, and calculating points according to the identification information of each of the drivers and the passage information recorded for each of the drivers.

Furthermore, still another aspect of the present disclosure is exemplified as an information processing method executed by a computer that includes a communication unit. The information processing method comprises the steps of: receiving, via the communication unit, identification information for identifying each of drivers recorded between start of running of a vehicle by sharing a ride to end and passage information recorded for each of the drivers; and calculating points according to the identification information of each of the drivers and the passage information recorded for each of the drivers.

Moreover, yet another aspect of the present disclosure is exemplified as a program causing a computer that includes a communication unit, to perform the steps of: receiving, via the communication unit, identification information for identifying each of drivers recorded between start of running of a vehicle by sharing a ride to end and passage information recorded for each of the drivers; and calculating points according to the identification information of each of the drivers and the passage information recorded for each of the drivers.

With the present disclosure, it is possible to provide a technique that evaluates the actual driving records of the drivers for ridesharing when there is a change of the driver.

BRIEF DESCRIPTION OF THE DRAWINGS

FIG. 5 is an example of reservation information stored in a reservation information DB;

FIG. 6 is an example of route traveling information stored in a ridesharing management DB;

FIG. 7 is an example of point management information stored in the ridesharing management DB;

DESCRIPTION OF THE EMBODIMENTS

Figure 1:
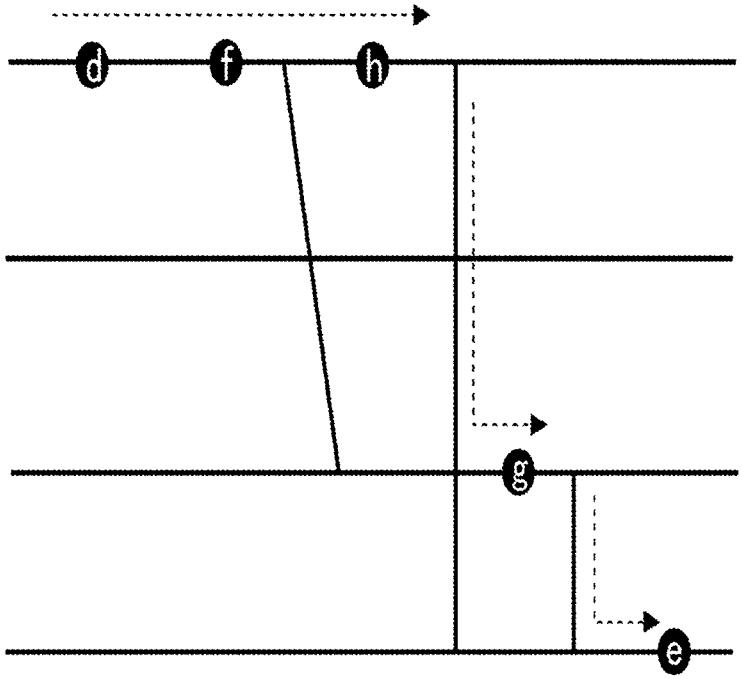
FIG. 1 is a diagram for describing a traveling mode by ridesharing.

A first mode of an embodiment is an onboard apparatus mounted on a vehicle used for ridesharing. The onboard apparatus according to the first aspect includes a communication unit and a controller. The controller executes: detection of start of running of a vehicle provided for sharing a ride; detection of a driver at the start of running; detection of change of the driver after the start of running; and measurement of passage information including at least one of running time and running distance until the change of the driver from the start of running, and transmission of the measured passage information to an information processing apparatus via the communication unit along with identification information for identifying the driver detected before the change of the driver.

With such aspect, the onboard apparatus can detect each of the drivers changed between the start of running of the vehicle to the end, and associate and transmit the identification information for identifying each of the detected drivers and the passage information of each of the drivers to the information processing apparatus. The information processing apparatus becomes capable of evaluating the actual driving records of each of the drivers of the vehicle used for ridesharing based on the transmitted information.

In the first aspect, the controller may further execute: upon detecting the change to a next driver, recording of the identification information for identifying the driver before the change to the next driver is detected along with the passage information measured for the driver before the change in a recording unit; and upon detecting end of running of the vehicle by sharing a ride, transmission of the identification information for identifying each of the drivers recorded between the start of running of the vehicle by sharing a ride to the end and the passage information recorded for each of the drivers to the information processing apparatus via the communication unit.

With such aspect, the onboard apparatus can record the passage information for each of the changed drivers by associating the passage information with the identification information of the drivers. Further, the onboard apparatus can transmit the passage information recorded for each of the drivers to the information processing apparatus by associating the passage information with the identification information of each of the drivers by taking the end of running of the vehicle as a trigger. In the present aspect, the onboard apparatus becomes capable of lightening the communication load with the communication unit.

A second aspect of the present embodiment is the information processing apparatus. The information processing apparatus according to the second aspect includes a communication unit and a controller. The controller executes: reception of the identification information for identifying each of the drivers recorded between the start of running of the vehicle used for sharing a ride to the end and the passage information recorded for each of the drivers via the communication unit; and calculation of points according to additional information for each of the drivers and the passage information recorded for each of the drivers.

With such aspect, the information processing apparatus can identify the passage information such as the running distance and running time regarding driving sections of each of the drivers who drove the vehicle based on the information received via the communication unit. Further, the information processing apparatus can calculate the points to be given to the drivers who took part in driving in ridesharing based on the identified passage information of each of the drivers. Furthermore, when the additional information of the driver indicates the provider of the vehicle, additional points related to providing the vehicle can be added further. With the second aspect of the present embodiment, incentives for participating in ridesharing can be given to the drivers even when there is change of the driver, so that the actual driving records of the drivers who took part in driving for ridesharing can be evaluated.

Hereinafter, an embodiment will be described with reference to the accompanying drawings. A configuration of the embodiment below is an example, and aspects for an embodiment are not limited to the configuration of the embodiment.

<First Embodiment>

In the present embodiment, described is a case of performing ridesharing when a plurality of users intended to travel share a ride on the same vehicle. First, referring to FIG. 1, outline of ridesharing will be described.

(Outline of Ridesharing)

FIG. 1 is a diagram for describing a traveling mode by using ridesharing. In FIG. 1, it is assumed that a plurality of users (A, B, and C) share a ride on the same vehicle. It is also assumed that the user A travels from a departure point d to a destination point e, the user B travels from a departure point f to a destination point g, and the user C travels from a departure point h to the destination point e.

Note here that three vehicles are needed if each of the users A to C is to travel separately to respective destinations. In the meantime, it is possible for the users A to C to travel to the respective destinations by a single vehicle by sharing a ride. In an example for explanation illustrated in FIG. 1, for example, the user A is the driver of the vehicle and drives the vehicle from the point d to the point e. In this case, the user A picks up the user B at the point f in the vehicle the user A is driving and picks up the user C at the point h in the vehicle the user A is driving. Then, the user A travels via the point g to allow the user B to alight on the way of driving the vehicle to the point e that is the destination of the user A and the user C for enabling the user B to travel from the departure point f to the destination point g. Thereafter, the user A can also achieve traveling of the user A along with traveling of the user C from the departure point h to the destination point e by driving the vehicle to the point e.

With such ridesharing, the number of vehicles running on the roads is relatively suppressed, so that it is expected to ease the traffic jam and the like in a commuting time zone, for example. Further, for example, the transportation cost (cost of fuel, passage fee, and the like) spent for traveling using a vehicle can be shared by a plurality of users sharing a ride on the vehicle, so that it is possible to lighten the transportation cost borne per user compared with a case where each user separately travels by own vehicle. Note that the mode of ridesharing illustrated in FIG. 1 is simply an example.

(System Configuration)

Figure 2:
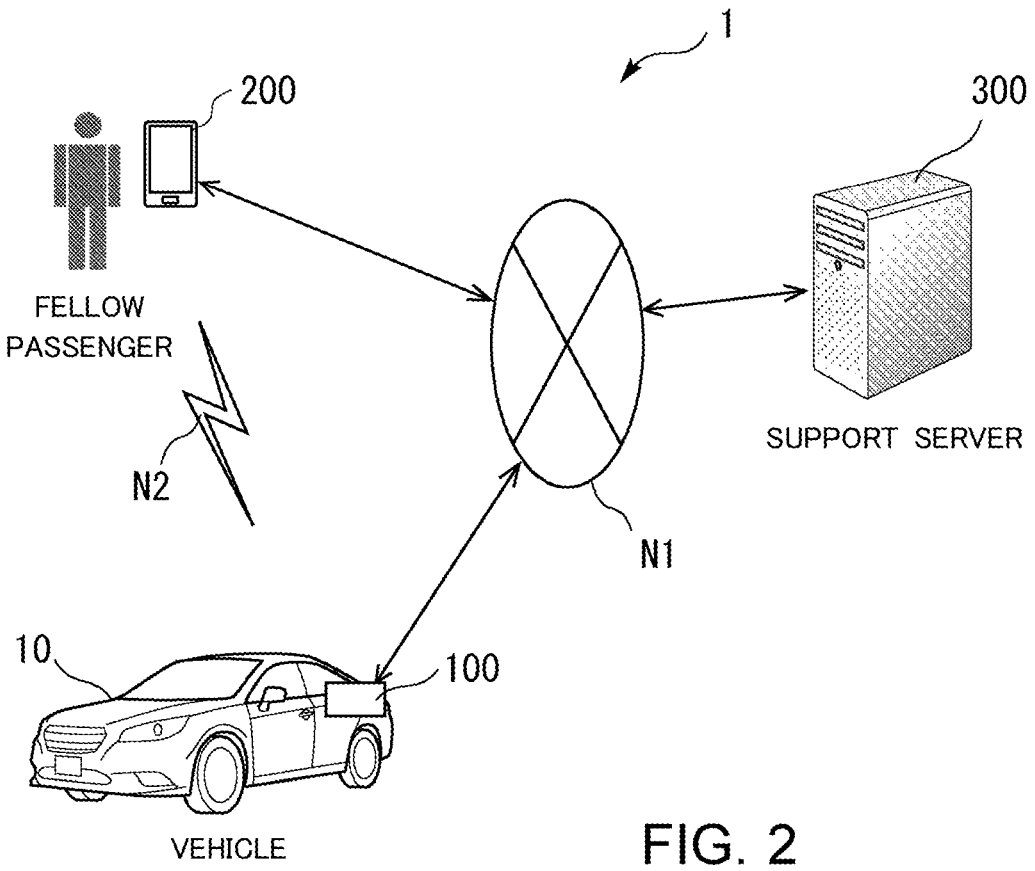
FIG. 2 is a diagram illustrating an example of a system configuration of a ridesharing support system according to a first embodiment.

FIG. 2 is a diagram illustrating an example of a system configuration of a ridesharing support system 1 according to the first embodiment. The ridesharing support system 1 is a system for supporting evaluation of the actual driving records of the drivers taking part in ridesharing through detecting change of the driver when traveling by ridesharing, recording passage information indicating the actual driving record done by the drivers, and calculating points to be given to the drivers according to the passage information.

The ridesharing support system 1 illustrated in FIG. 2 includes: the vehicle 10 used for sharing a ride; an onboard apparatus 100 mounted on the vehicle 10; a user terminal 200 carried by the user (fellow passenger) sharing a ride on the vehicle 10; and a support server 300. The onboard apparatus 100, the user terminal 200, and the support server 300 are connected mutually via a network N1. Further, the onboard apparatus 100 and the user terminal 200 are connected via a network N2. The network N1 is a public network such as the Internet, for example. The network N1 may include a radio network of a mobile phone network, a dedicated network such as VPN (Virtual Private Network), LAN (Local Area Network), and the like. The network N2 may be a near field radio network including Bluetooth®, NFC (Near Field Communication), BLE (Bluetooth Low Energy), and the like. The onboard apparatus 100 and the user terminal 20 are directly communicable via the network 2 inside the vehicle, for example.

In FIG. 2, illustrated as typical examples are the single vehicle 10 as the vehicle used for sharing a ride, the single user terminal 200, and the single support server 300. To the network N1 of FIG. 2, a plurality of support servers providing ridesharing support according to the present embodiment can be connected. Further, a plurality of onboard apparatuses each set on the vehicle to be a support target of each of the support servers providing the ridesharing support according to the present embodiment can be connected to the network N1. Furthermore, a plurality of user terminals carried by fellow passengers sharing a ride on the vehicles provided with the ridesharing support and a plurality of user terminals of the drivers driving the vehicles provided with the ridesharing support can be connected to the network N1.

The onboard apparatus 100 according to the present embodiment records positional information of the own vehicle at the time of traveling on a route in ridesharing at a constant interval or by associating it with occurrence of an event such as change of the driver. When there is change of the driver, the identification information for identifying the driver is given and recorded. In the onboard apparatus 100 according to the present embodiment, the passage information indicating the actual driving record associated with the identification information is recorded as a history of the positional information.

Specifically, the onboard apparatus 100 acquires positional information of the own vehicle at the time of traveling on the route by ridesharing at a constant interval, and records the acquired positional information by associating it with information of time when the positional information is acquired. The positional information of the own vehicle at the time of traveling on the route is acquired regularly such as every prescribed unit distance like 100 m or every unit time like 30 seconds. Further, the onboard apparatus 100 detects occurrence of an event, i.e., change of the driver, and records the identification information of the detected driver and the positional information of the vehicle 10 where the change took place by associating them with the time information. Similarly, the onboard apparatus 100 acquires positional information of a riding point of the fellow passenger to the vehicle 10 as well as positional information of an alighting point of the fellow passenger from the vehicle 10, and records the acquired positional information by associating them with information of time when the positional information is acquired. The onboard apparatus 100 notifies the support server 300 of the positional information recorded at the time of traveling on the route by ridesharing and at occurrence of an event.

With the present embodiment, the passage information such as the running distance and the running time regarding the driving sections of each of the drivers who drove the vehicle 10 at the time of traveling on the route is identified based on the positional information acquired at occurrence of an event or at a constant interval, the time information, and the identification information of the driver. Further, with the present embodiment, the points to be given to the drivers as the incentives for ridesharing are calculated based on the identified passage information for each of the drivers. Note that details of the onboard apparatus 100 will be described later.

In the user terminal 200, an application program (also referred to as "app" hereinafter) for enjoying ridesharing is installed, for example. The user wishing to travel by sharing a ride can register information regarding conditions and the like for sharing a ride (referred to as "request information" hereinafter) to the support server 300 by executing the app on the own user terminal 200. For example, the information regarding a riding section, riding date/time and the like when the user wishes to travel by sharing a ride can be registered with the support server 300 as the request information. Further, the planned driver planning to drive the vehicle 10 can register the information regarding a running section, a running date/time and the like of the vehicle 10 planned to be driven with the support server 300 as the request information by executing the app on the own user terminal 200.

The support server 300 accepts the request information from the planned driver of the vehicle 10 and the request information from the user wishing to travel by sharing a ride. Then, the support server 300 performs matching for pairing the planned driver and the user sharing a ride on the vehicle based on the request information from the planned driver of the vehicle 10 and the request information from the user wishing to travel by sharing a ride. Note here that matching means linking the planned driver allowing a ride on the vehicle with the user wishing to travel by sharing a ride such that mutual conditions are satisfied. The support server 300 can perform matching of the planned driver of the vehicle 10 and the user wishing to travel by sharing a ride by using a known technique. For example, the support server 300 may select a vehicle the user can share a ride from vehicles that include at least the riding point or the alighting point of the user wishing to travel by sharing a ride in the running section and include the riding period wished by the user in the planned running period of the running section.

When processing of matching is completed, the support server 300 notifies, to the user terminal 200 of the user wishing to travel by sharing a ride, vehicle information of the vehicle 10 allowing a ride, planned driver information of the vehicle 10, travel information and the like of the vehicle 10. The vehicle information includes a model, a color type, a vehicle number, and the like of the vehicle, for example. The planned driver information includes sex, age, and the like, for example. The travel information includes a planned riding place to the vehicle 10, a planned alighting place, planned riding time, planned alighting time, existence of other fellow passengers, and the like, for example. Further, the support server 300 notifies, to the user terminal 200 of the planned driver of the vehicle 10, the information regarding sex and age of the fellow passenger, a riding place wished by the fellow passenger, planned riding time, destination, and the like. Then, when the planned driver and the user wishing to travel by sharing a ride approve matching based on the notified information, the user (fellow passenger) sharing a ride on the vehicle 10 is settled.

In addition to the functions described above, the support server 300 according to the present embodiment acquires positional information of the vehicle 10 at the time of traveling on the route notified from the onboard apparatus 100. In the positional information at the time of traveling on the route, included is the positional information detected at a constant interval or detected by corresponding to occurrence of an event by being associated with the time information. When there is change of the driver, for example, the identification information for identifying the detected driver is included by being associated with the positional information and the time information. Further, when there is riding or alighting of the fellow passenger, the identification information for identifying the fellow passenger is included by being associated with the positional information and the time information.

Further, the support server 300 identifies the detected events (change of the driver, riding and alighting of the fellow passenger, and the like) from the history of the acquired positional information. When there is change of the driver, the support server 300 identifies the passage information such as the running distance and the running time regarding the driving sections of each of the drivers who drove the vehicle 10 at the time of traveling on the route. Then, the support server 300 according to the present embodiment calculates the points to be given to the drivers taking part in ridesharing based on the identified passage information for each of the drivers. With the present embodiment, incentives for ridesharing can be given to the drivers even when there is change of the driver, so that the actual driving records of the drivers who took part in driving in ridesharing can be evaluated. Note that details of the support server 300 will be described below.

(Hardware Configuration)

Figure 3:
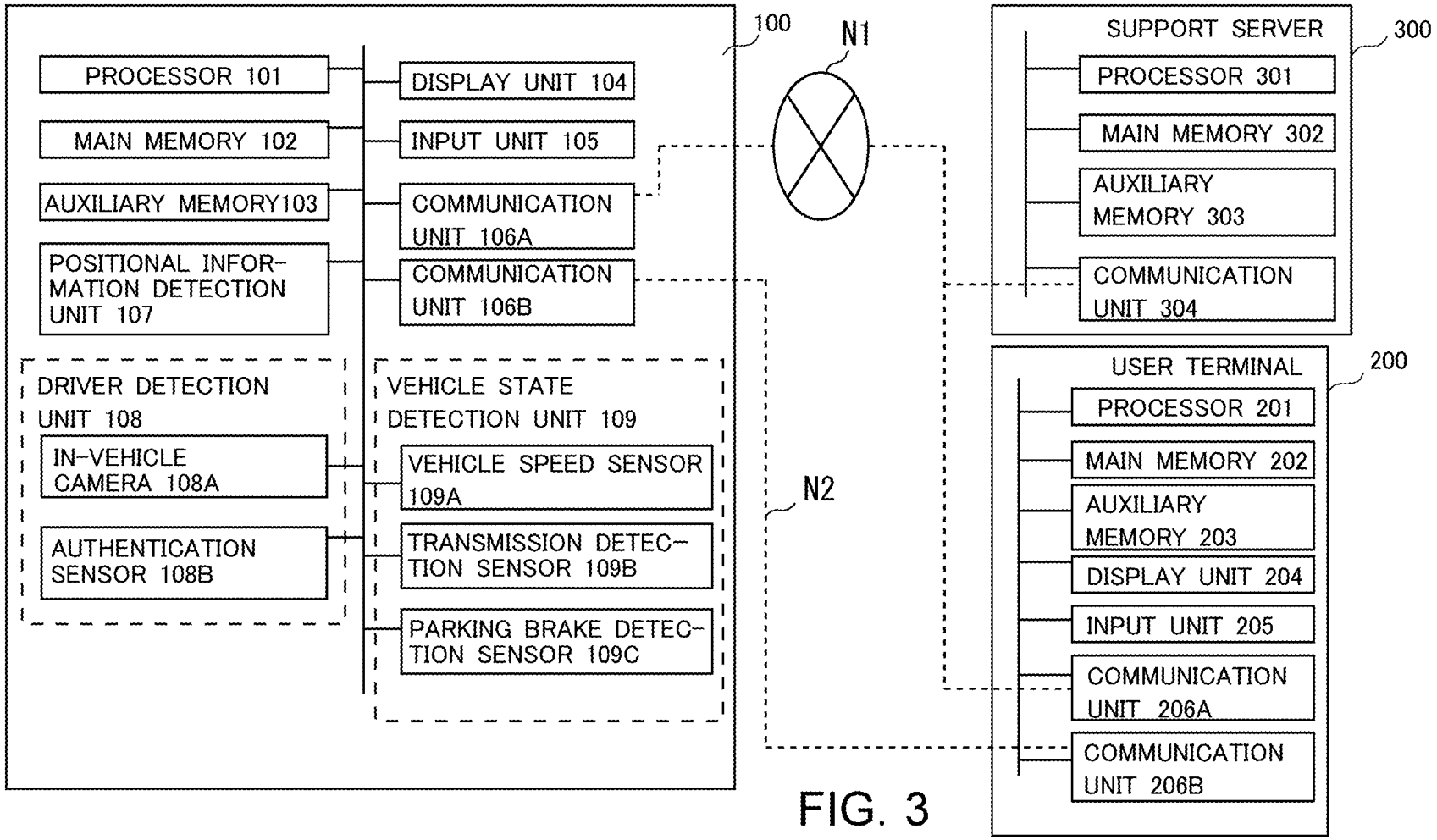
FIG. 3 is a diagram illustrating an example of hardware configuration of an onboard apparatus, a user terminal, and a support server.

FIG. 3 is a diagram illustrating an example of each hardware configuration of the onboard apparatus 100, the user terminal 200, and the support server 300. The support server 300 is a general-purpose or dedicated computer, for example. As components, the support server 300 includes a processor 301, a main memory 302, an auxiliary memory 303, and a communication unit 304 connected mutually via a bus. The main memory 302 and the auxiliary memory 303 are recording media that can be read by the support server 300. A plurality of each of the above components may be provided or some of the components may be omitted. The support server 300 is an example of an "information processing apparatus". The processor 301 is an example of a "controller". The communication unit 304 is an example of "communication unit".

The processor 301 is a CPU (Central Processing Unit), for example. The processor 301 executes a computer program loaded to be executable on a work area of the main memory 302, and performs control of the whole support server 300. The processor 301 provides the function matching a prescribed subject by controlling peripheral apparatuses through execution of the computer program. Note, however, that the processor 301 is not limited to be a single processor but may be a multiprocessor configuration. Also, the single CPU connected via a single socket may be a multicore configuration. Further, a part of processing functions provided by the support server 300 may be provided by a DSP (Digital Signal Processor), an ASIC (Application Specific Integrated Circuit), a GPU (Graphics Processing Unit), and the like. Furthermore, at least some of the processing functions may be an FPGA (Field-Programmable Gate Array), an exclusive LSI (Large Scale Integration) such as a numerical processor or an image processing processor, other digital circuit and analog circuit.

The main memory 302 stores therein a computer program executed by the processor 301 as well as data and the like processed by the processor 301. The main memory 302 is a flash memory, a RAM (Random Access Memory), a ROM (Read Only Memory) or the like, for example. The auxiliary memory 303 is a nonvolatile memory device for storing various kinds of programs and various kinds of data in a recording medium in a freely readable and writable manner. The auxiliary memory 303 is also called an external memory device. The auxiliary memory 303 is a flash memory, an HDD (Hard Disk Drive), an SSD (Solid State Drive), or the like, for example. An OS (Operating System), for example, is included in the various kinds of programs stored in the auxiliary memory 303. The OS includes a communication interface program for exchanging data with external devices and the like connected via the communication unit 304.

The communication unit 304 is an interface with the network N1. The communication unit 304 includes a LAN (Local Area Network) interface board and a radio communication circuit for radio communication. The support server 300 connects to the network N1 via the communication unit 304 and communicates with the onboard apparatus 100, the user terminal 200, and the like via the network N1.

Note that the hardware configuration of the support server 300 is not limited to the configuration illustrated in FIG. 3. For example, the support server 300 is capable of reading the program recorded in a removable recording medium, and loading the program on the main memory 302 to execute the program. Examples of the removable recording medium may be a disc recording media such as a USB (Universal Serial Bus) memory, a CD (Compact Disc), a DVD (Digital Versatile Disc), and a Blu-ray® disc.

The user terminal 200 is a small computer such as a smartphone, a mobile phone terminal, a tablet terminal, a personal information terminal, or a wearable computer (smartwatch or the like), for example. The user terminal 200 may be a PC (Personal Computer) that can be carried by the user.

The user terminal 200 includes a processor 201, a main memory 202, an auxiliary memory 203, a display unit 204, an input unit 205, a communication unit 206A, and a communication unit 206B. The processor 201, the main memory 202, and the auxiliary memory 203 are similar to the processor 301, the main memory 302, and the auxiliary memory 303 of the support server 300, so that explanations thereof are omitted. Note that the app for enjoying ridesharing is stored in the auxiliary memory 203 of the user terminal 200.

The display unit 204 is an LCD (Liquid Crystal Display), an EL (Electroluminescence) panel, or the like. The input unit 205 includes a touch panel or push buttons capable of inputting symbols such as characters, a microphone capable of inputting voice, a camera or the like capable of capturing motion videos and still pictures, for example.

The communication unit 206A is a communication circuit corresponding to a communication system employed for a mobile phone network such as radio communication like WiFi, LTE, LTE-Advanced, 3G, and the like. The user terminal 200 accesses the network N1 via the communication unit 206A to communicate with the support server 300 and the like.

The communication unit 206B is a communication circuit corresponding to a near field radio communication such as Bluetooth®, NFC, and BLE, for example. The user terminal 200 accesses the network N2 via the communication unit 206B to communicate with the onboard apparatus 100 mounted on the vehicle 10.

The onboard apparatus 100 is a computer capable of being mounted on the vehicle 10. The onboard apparatus 100 includes a processor 101, a main memory 102, an auxiliary memory 103, a display unit 104, an input unit 105, a communication unit 106A, a communication unit 106B, a positional information detection unit 107, a driver detection unit 108, and a vehicle state detection unit 109. The processor 101, the main memory 102, and the auxiliary memory 103 are similar to the processor 301, the main memory 302, and the auxiliary memory 303 of the support server 300, so that explanations thereof are omitted. Further, the display unit 104, the input unit 105, the communication unit 106A, and the communication unit 106B are similar to the display unit 204, the input unit 205, the communication unit 206A, and the communication unit 206B of the user terminal 200, so that explanations thereof are omitted. Note that a speaker for giving a voice guidance, a message, and the like may be provided to the display unit 104. A plurality of each of the above components may be provided or some of the components may be omitted. The onboard apparatus 100 is an example of the "onboard apparatus". The processor 101 is an example of the "controller". The communication unit 106A is an example of the "communication unit".

The positional information detection unit 107 detects positional information (latitude, longitude) of the own vehicle based on GPS signals from a plurality of GPSs (Global Positioning Satellites) orbiting the earth. The positional information detection unit 107 acquires the detected positional information at a prescribed interval, and records the positional information by associating it with the acquired time information. Further, the positional information detection unit 107 acquires the positional information in accordance with a changing event of the driver, and records the acquired positional information by associating it with the time information at the time of occurrence of the event. Furthermore, the positional information detection unit 107 acquires the positional information in accordance with a riding event and an alighting even of the fellow passenger to/from the vehicle 10, and records the acquired positional information by associating it with the time information at the time of occurrence of the events. The information recorded by the positional information detection unit 107 is transmitted to the support server 300 connected to the network N1 via the communication unit 106A regularly or in response to a request from the support server 300.

Note that the onboard apparatus 100 may cooperate with a navigation apparatus or the like mounted on the vehicle 10 to acquire the positional information detected via a GPS reception unit provided to the navigation apparatus or the like. For example, the onboard apparatus 100 connects to an in-vehicle network such as a CAN (Controller Area Network) provided inside the vehicle. Then, the positional information detection unit 107 may acquire the positional information detected by the navigation apparatus or the like via the connected in-vehicle network.

Furthermore, when the onboard apparatus 100 cooperates with the navigation apparatus or the like mounted on the vehicle 10, it is possible to share the display unit, the input unit, and the like of the navigation apparatus or the like, for example, and allot those units to components capable of being used. Further, the onboard apparatus 100 becomes capable of using various kinds of functions provided by the navigation apparatus or the like, such as functions of setting transit points (riding points, alighting points) for ridesharing, guiding the route to the destination points including the transit points, and providing map information corresponding to the vehicle position, for example.

The driver detection unit 108 detects the driver who drives the vehicle 10 when traveling by using ridesharing. The driver detection unit 108 as illustrated in FIG. 3 includes at least one of an in-vehicle camera 108A and an authentication sensor 108B. While a processing example using the in-vehicle camera 108A and the authentication sensor 108B will be described in the following embodiment, either the in-vehicle camera 108A or the authentication sensor 108B may be omitted.

The in-vehicle camera 108A captures images of the driver sitting on a driver's seat of the vehicle 10. The authentication sensor 108B detects authentication information of the driver sitting on the driver's seat of the vehicle 10. Note, however, that the sensors and apparatuses for detecting the driver are not limited to the components of FIG. 3. The driver detection unit 108 records the captured face image of the driver and the detected authentication information of the driver by associating them with the positional information and the time information. The information recorded by the driver detection unit 108 is transmitted to the support server 300 connected to the network N1 via the communication unit 106A, for example, regularly or in response to a request of the support server 300.

The in-vehicle camera 108A is an image capturing device using an image sensor such as CCD (Charged-Coupled Device), a CMOS (Complementary Metal-Oxide-Semiconductor), or the like. The in-vehicle camera 108A is provided at a casing frame of an inner rear-view mirror (room mirror), and captures videos of the vicinity of the driver's seat at a prescribed frame period (30 fps, for example). When the driver who drives the vehicle 10 is sitting on the driver's seat, the face image of the driver is captured.

The onboard apparatus 100 may also cooperate with a drive recorder or the like mounted on the vehicle 10 instead of the in-vehicle camera 108A, and acquire video information inside the vehicle captured via an image capturing unit provided by the drive recorder or the like. The onboard apparatus 100 may acquire the video information inside the vehicle captured by the drive recorder or the like via the in-vehicle network such as the CAN, for example.

The authentication sensor 108B is a sensor for detecting information related to biometric authentication for identifying the driver of the vehicle 10. An example of the authentication sensor 108B may be a fingerprint sensor for reading out fingerprint patterns. The fingerprint sensor is provided as a fingerprint authentication button in a steering wheel, a dashboard, or a meter panel, for example. An example of the fingerprint sensor may be a capacitance type that detects the fingerprint patterns by sensing an electric charge amount of the sensor pressed by the thumb, the index finger, or the like, for example. The fingerprint patterns read out by the fingerprint sensor are compared with pre-registered fingerprint data by a method such as pattern matching. Note, however, that the authentication sensor 108B is not limited to the fingerprint sensor. For example, an iris recognition sensor that reads out iris patterns of the drivers, a voiceprint sensor that reads out voiceprint patterns, or venous pattern detection sensor that detects venous patterns may be employed as well. Further, face authentication may be executed based on the face image captured via the in-vehicle camera 108A. In the present embodiment, as will be described later, when the face image of the driver captured via the in-vehicle camera 108A at the time of occurrence of an event is different from the face image of the driver before the occurrence of the event, for example, the driver is informed to read out the fingerprint pattern via the fingerprint authentication button. Then, the driver after change is identified from the fingerprint pattern read out via the fingerprint authentication button, and the driver is recorded by being associated with the positional information and the time information at the time of occurrence of the event.

The vehicle state detection unit 109 forms a part of the sensor group provided to the vehicle for controlling the running state of the vehicle 10. The onboard apparatus 100 connects to an ECU (Electronic Control Unit) that generally manages a part of or all of the sensor group via the in-vehicle network such as CAN provided inside the vehicle, for example. Then, the onboard apparatus 100 may acquire the information detected by each sensor element forming the vehicle state detection unit 109 via the ECU. The vehicle state detection unit 109 includes a vehicle speed sensor 109A, a transmission detection sensor 109B, and a parking brake detection sensor 109C as illustrated in FIG. 3. The vehicle speed sensor 109A detects the vehicle speed of the vehicle 10. The transmission detection sensor 109B detects a transmission state at the time of driving the vehicle 10. The parking brake detection sensor 109C detects an on/off state of the parking brake of the vehicle 10 at the time of parking. Note that the sensors and devices forming the vehicle state detection unit 109 are not limited to the configuration illustrated in FIG. 3.

The vehicle speed sensor 109A is a sensor for detecting the speed of the own vehicle based on a vehicle speed signal generated according to a rotation speed of an axle, for example. The transmission detection sensor 109B is a sensor for detecting which of the states such as a drive mode "D", a stop mode "N" and "P", and a reverse mode "R" the transmission state of the vehicle 10 is in. The parking brake detection sensor 109C is a sensor for detecting whether the state of the parking brake forming a part of a braking mechanism of the vehicle 10 is the on-state or the off-state.

In the present embodiment, a stop state of the vehicle due to the events such as change of the driver, riding and alighting of the fellow passenger is identified based on the information indicating the state of the vehicle detected by the vehicle state detection unit 109. Then, the onboard apparatus 100 records the identification information of the driver, the identification information of the fellow passenger, and the like corresponding to the events by associating them with the positional information and the time information at the time of occurrence of the events. The support server 300 identifies the driving sections for each of the drivers based on the information included in the history of the positional information, for example, and identifies the passage information regarding the driving sections. In the present embodiment, the points to be given to the drivers taking part in driving in ridesharing are calculated based on the identified passage information.

(Functional Configuration: Support Server)

Figure 4:
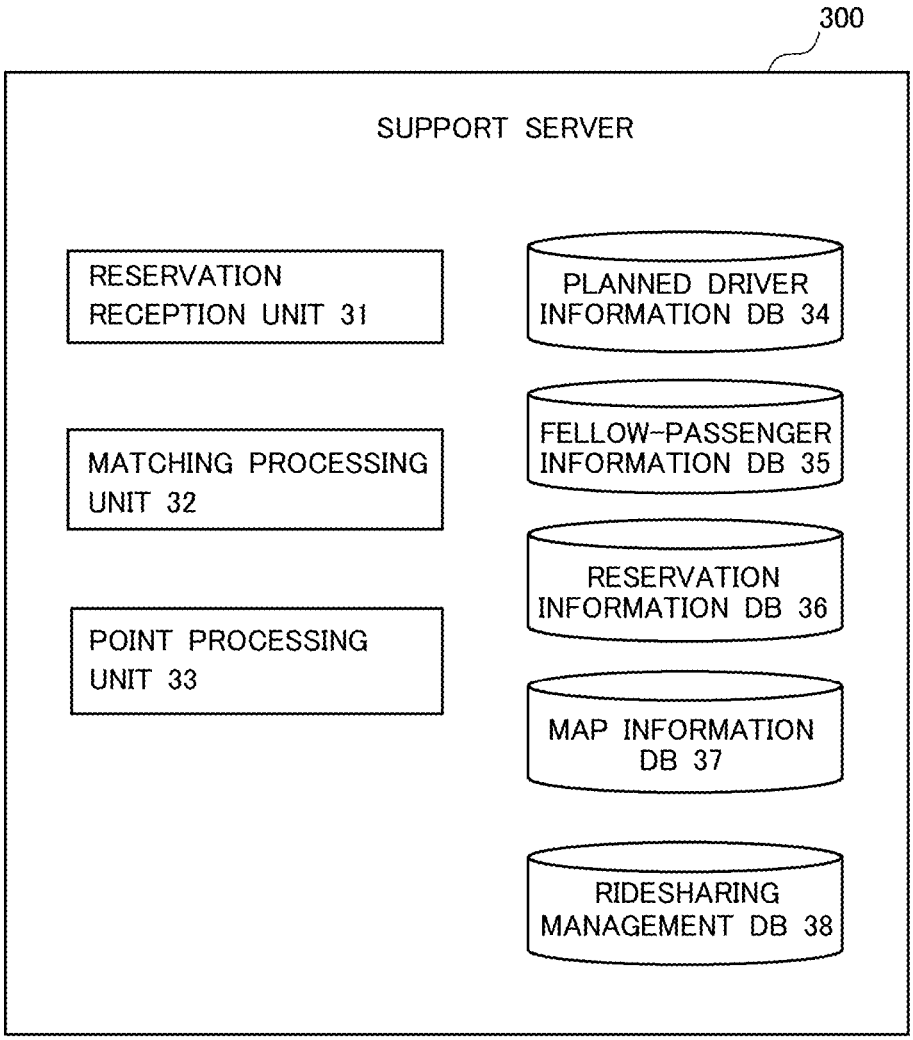
FIG. 4 is a diagram illustrating an example of a functional configuration of the support server.

FIG. 4 is a diagram illustrating an example of a functional configuration of the support server 300. As the functional components, the support server 300 includes a reservation reception unit 31, a matching processing unit 32, a point processing unit 33, a planned driver information database (DB) 34, a fellow-passenger information DB 35, a reservation information DB 36, a map information DB 37, and a ridesharing management DB 38. In the map information DB 37, stored is map information including map data having feature positions and POI (Point Of Interest) information such as characters and pictures indicating properties of each point on the map data. Note that the map information DB 37 may be provided from another system connected to the network N1, such as a GIS (Geographic Information System). Those functional components are the functional components provided when the processor 301 of the support server 300 executes various kinds of programs stored in the auxiliary memory 303. However, any one of the functional components or a part of the processing thereof may be executed by a hardware circuit. Further, any one of the functional components or a part of the processing thereof may be executed by another computer connected to the network N1.

The reservation reception unit 31 accepts the request information of the fellow passenger wishing to travel by sharing a ride, and stores the request information in the fellow-passenger information DB 35. The request information of the fellow passenger wishing to travel by sharing a ride is stored in the fellow-passenger information DB 35 by being associated with identification information (user ID) for identifying the fellow passenger. Note here that the user ID is, for example, member information that is given when downloading the app for enjoying ridesharing. Upon receiving a ridesharing request from the user terminal 200 operated by the fellow passenger via the communication unit 304, the reservation reception unit 31 acquires the user ID included in the ridesharing request. Then, the reservation reception unit 31 generates a record including the acquired user ID and the request information, and stores the record in the fellow-passenger information DB 35. After storing the request information and the like in the fellow-passenger information DB 35, the reservation reception unit 31 requests matching to the matching processing unit 32.

In the fellow-passenger information DB 35, stored is the request information including information indicating a place wished to ride (riding point), information indicating date and time wished to ride, information indicating a place wished to alight (alighting point), information indicating date and time wished to alight, sex, an age, and the like of the fellow passenger. Hereinafter, the user ID given to the fellow passenger is also referred to as a "fellow-passenger ID".

Further, the reservation reception unit 31 accepts the request information from the planned driver of the vehicle 10 allowed to share a ride, and stores the request information in the planned driver information DB 34. The request information from the planned driver of the vehicle 10 allowed to share a ride is stored in the planned driver information DB 34 by being associated with the identification information (user ID) identifying the planned driver (hereinafter, the user ID given to the planned driver is also referred to as a "planned driver ID"). Like the fellow-passenger ID, the planned driver ID is member information that is given when downloading the app for enjoying ridesharing. Upon receiving a running plan notification regarding the vehicle 10 from the user terminal 200 operated by the planned driver via the communication unit 304, the reservation reception unit 31 acquires the planned driver ID included in the running plan notification. Then, the reservation reception unit 31 generates a record including the acquired planned driver ID and the request information, and stores the record in the planned driver information DB 34.

In the planned driver information DB 34, stored is the request information including information indicating a departure point of the vehicle 10, information indicating planned date and time to be departed from the departure point, information indicating the destination the vehicle 10 is to arrive, information indicating planned date and time to be arrived at the destination, sex, an age, and the like of the planned driver. Further, in the planned driver information DB 34, stored are biometric patterns (fingerprint, iris, voiceprint, or the like) related to authentication of the planned driver, the face image, the information for identifying the vehicle 10, and the identification information for identifying the onboard apparatus 100. The information identifying the vehicle 10 may be a model, a color type, and a vehicle number of the vehicle 10, and the like.

Note that actual record information of the fellow passenger who provides traveling by ridesharing as the planned driver, for example, is also included in the planned driver information DB 34. When the actual record of the fellow passenger as the planned driver is stored in the planned driver information DB 34, the fellow-passenger ID given to the fellow passenger is to match the planned-driver ID stored as the actual record in the planned driver information DB 34. Further, the biometric patterns (fingerprint, iris, voiceprint, or the like) related to authentication of the fellow passenger and the face image are stored.

The matching processing unit 32 performs matching for connecting the planned driver allowing a ride to share the vehicle and the fellow passenger wishing to travel by sharing a ride such that the mutual conditions are satisfied in response to the request from the reservation reception unit 31. As has been described, the matching processing can be done by using a known technique.

For example, a vehicle capable of sharing a ride is selected from the vehicles that include at least one of the riding point or the alighting point of the fellow passenger in the running section and include the planned period for running in the running section including the riding period the fellow passenger wishes to ride. Then, the matching processing unit 32 notifies the various kinds of information (planned driver information, traveling information, vehicle information, and the like) regarding the selected vehicle to the user terminal 200 of the fellow passenger. Further, the matching processing unit 32 notifies the various kinds of information (sex, age, desired riding point, desired riding time, desired alighting point, desired alighting time, and the like) of the fellow passenger to the user terminal 200 of the planned driver of the selected vehicle. When both approve the matching based on the information notified to each of the planned driver and the fellow passenger, ridesharing that is to travel by sharing the vehicle 10 is settled. After the ridesharing is settled, the matching processing unit 32 stores the information regarding the settled ridesharing in the reservation information DB 36. Note that the support server 300 notifies the reservation information regarding the vehicle 10 having the onboard apparatus mounted thereon in response to a request from the onboard apparatus 100.

FIG. 5 is an example of the reservation information stored in the reservation information DB 36. As illustrated in FIG. 5, the reservation information regarding the settled ridesharing is managed as a reservation information table. Note that it is possible to add, change, and delete a field as appropriate for the information registered with the reservation information table.

The reservation information table illustrated in FIG. 5 includes each field of a reservation ID, a planned driver ID, a vehicle number, a destination, a fellow-passenger ID, a planned riding point, planned riding date and time, a planned alighting point, and planned alighting date and time. In the reservation ID field, stored is the reservation IDs for identifying each piece of reservation information. The reservation ID is given by the matching processing unit 32 to each piece of information regarding the settled ridesharing. In the planned driver ID field, stored is the ID for identifying the planned driver of the vehicle 10 allowing to share a ride. In the vehicle number field, stored is the ID (for example, vehicle registration number (number on a license plate)) for identifying the vehicle 10. In the destination field, stored is the information indicating the destination of the vehicle 10 allowing to share a ride. Examples of the information indicating the destination may be the address of the destination, the latitude/longitude, the name of a landmark, and the like. In the fellow-passenger ID field, stored is the ID of the fellow passenger who is settled to share a ride on the vehicle 10.

In the planned riding point field, stored is the information of the planned riding point of the fellow passenger settled to share a ride. Examples of the information of the planned riding point may be the latitude/longitude of the planned riding place, the address, and the name of a landmark. In the planned riding date and time field, registered is the information indicating the planned date and time the fellow passenger settled to share a ride is to ride on the vehicle. In the planned alighting point field, stored is the information of the planned alighting point of the fellow passenger settled to share a ride. The information of the planned alighting point is similar to the information of the planned riding point. In the planned alighting date and time field, stored is the information indicating the planned date and time the fellow passenger settled to share a ride is to alight from the vehicle.

In "S002" of the reservation ID illustrated in FIG. 5, the destination of the vehicle 10 driven by a planned driver D002 is "e". Further, it is illustrated that the planned driver D002 picks up a fellow passenger P001 at a point f at "2018/07/06 9:10" and drives the vehicle 10 toward a point g that is the planned alighting point. Further, it is illustrated that the planned driver D002 picks up a fellow passenger P002 at a point h at "2018/07/06 9:20", and drives the vehicle 10 toward the point e that is the planned alighting point. As described in FIG. 1, the planned alighting point g of the fellow passenger P001 is a via point of the route toward the destination the vehicle 10 arrives and the planned alighting point e of the fellow passenger P002.

Returning to FIG. 4, the point processing unit 33 performs calculation processing of points to be given to each of the drivers taking part in driving at the time of traveling on the route by ridesharing. Specifically, the point processing unit 33 acquires the information regarding the positional information at the time of traveling on the route notified regularly or in accordance with occurrence of an event from the vehicle 10 registered with the reservation information DB 36. The acquired positional information at the time of traveling on the route is registered with the ridesharing management DB 38 as route traveling information by being associated with the reservation ID corresponding to the vehicle 10. Then, the point processing unit 33 calculates the points to be given to the driver based on the history of the positional information as the route traveling information registered with the ridesharing management DB 38 in response to a request from the vehicle 10, for example. As has been described above, when there is change of the driver, the information for identifying the driver after the change is included in the history of the positional information.

The point processing unit 33 calculates the points by taking the passage information such as the running distance and the running time regarding the driving sections of each of the drivers as the evaluation condition, for example. The point processing unit 33 identifies the running distance and the running time for each of the driving sections driven by the drivers from the time information associated with the positional information and the information identifying the driver, for example. Then, the point processing unit 33 calculates the points for each of the driving sections according to the identified passage information. The calculated points are given to the drivers who drove the driving sections. Note that identification of the running distance of each of the driving sections is done by referring to the map information DB 37. For example, the point processing unit 33 refers to the map information DB 37, and identifies the running distance for the route of the driving sections. Then, the point processing unit 33 can give the points that increment stepwise in accordance with the identified running distance and the distance segment of the running distance, such as a case of less than 10 km, a case of 10 km or more and less than 20 km, and a case of 20 km or more and less than 30 km, for example.

This also applies to the running time. The running time of each of the driving sections may be identified based on the time information associated with the positional information. The point processing unit 33 can give the points that increment stepwise in accordance with the identified running time and the time segment the running time belongs to, such as a case of less than 20 minutes, a case of 20 minutes or more and less than 30 minutes, and a case of 30 minutes or more and less than 40 minutes, for example.

Further, the point processing unit 33 may give the points by distinguishing the provider of the vehicle 10 used for ridesharing. For example, fixed points defined in advance may be given to the driver who is the provider of the vehicle 10, while such fixed points are not given to the other drivers. The support server 300 can give special incentives to the provider of the vehicle 10.

The point processing unit 33 registers the points calculated according to the passage information of the driving sections and the segment of the provider of the vehicle 10 to the ridesharing management DB 38. Further, the point processing unit 33 notifies the calculated points to the onboard apparatus 100.

FIG. 6 is an example of the route traveling information stored in the ridesharing management DB 38. The positional information acquired from the vehicle 10 at the time of traveling on the route are managed as a route traveling information table as illustrated in FIG. 6. Note that it is possible to add, change, and delete a field as appropriate for the information registered with the route traveling information table.

The route traveling information table illustrated in FIG. 6 includes each field of the reservation ID, the owner ID, the section, the persons on board, and the positional information history. The reservation ID is the same as those in FIG. 5, so that explanations are omitted. In the owner ID field, stored is the identification information (ID) for identifying the provider of the vehicle 10. The provider of the vehicle 10 is the owner of the vehicle 10, for example, and is a planned driver registered in the planned driver information DB 34 with the reservation ID. In the section field, stored is the information indicating the section connecting between the points where the events such as change of the driver as well as riding and alighting of the persons on board (driver and fellow passengers) of the vehicle 10 took place. In the persons on board field, stored is the information indicating the persons on board of the vehicle 10 when traveling the section. The planned driver of the vehicle 10 and the fellow passengers are included in the persons on board. In the positional information history field, stored are the identification numbers for identifying the history data of the positional information of the vehicle 10 corresponding to the section.

FIG. 7 is an example of point management information stored in the ridesharing management DB 38. The points calculated by the point processing unit 33 are managed as the point management information table as illustrated in FIG. 7. Note that FIG. 7 is a management example of a mode that gives driving points for the driving sections of each of the persons on board. Note that it is possible to add, change, and delete a field as appropriate for the information stored in the point management information table.

The point management information table illustrated in FIG. 7 includes each field of the reservation ID, the persons on board, the owner point, the driving point, and total points. The reservation ID, persons on board field are the same as that in FIG. 6, so that explanations are omitted. In the owner point field, stored is the information indicating the points to be given to the provider of the vehicle 10. In the driving point field, stored are the points calculated by corresponding to the driving sections of the persons on board.

The driving point field includes each of sub-fields of the running distance and the running time. In the running distance sub-field, stored are the points calculated by corresponding to the running distance of the driving sections. In the running time sub-field, stored are the points calculated by corresponding to the running time of the driving sections. In the total point field, stored are the points calculated by the point processing unit 33 to be given to the driver. In FIG. 7, an example of a processing expression for calculating the total points is illustrated. Note that details of the information stored in the owner point field, the driving point field, and the total point field will be described later.

(Functional Configuration: Onboard Apparatus)

Figure 8:
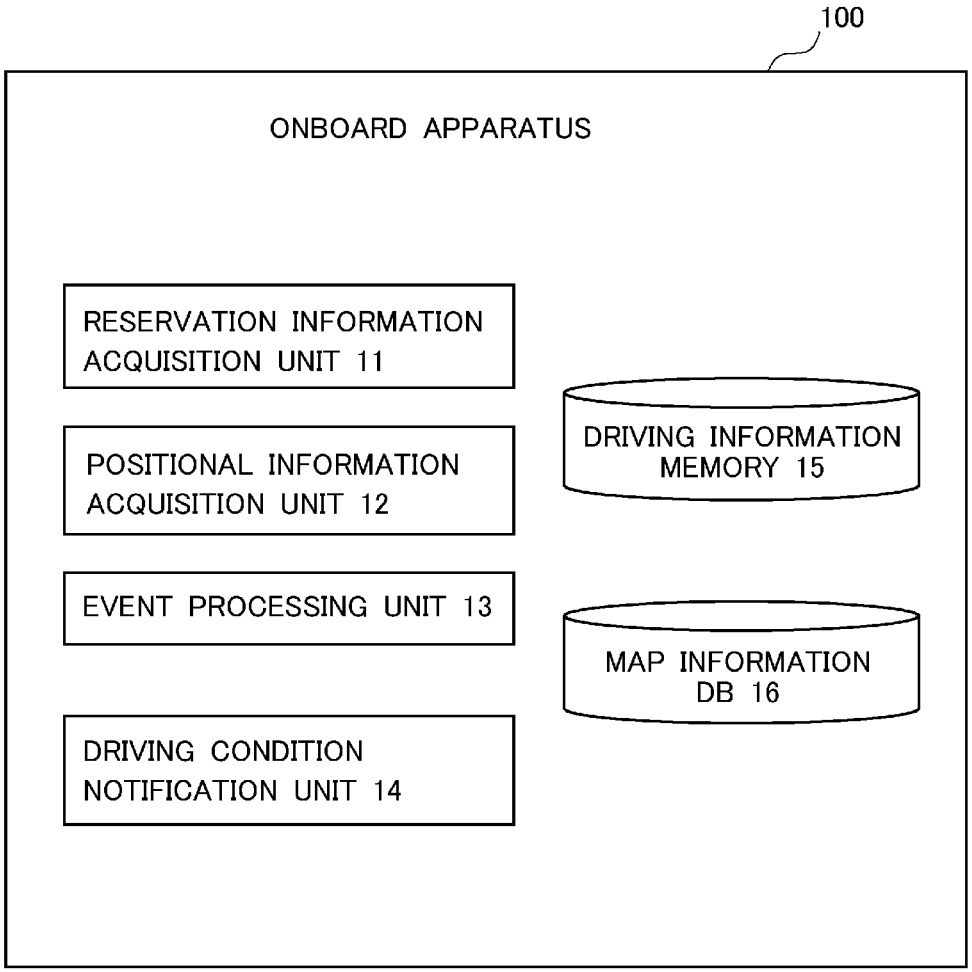
FIG. 8 is a diagram illustrating an example of a functional configuration of the onboard apparatus.

FIG. 8 is a diagram illustrating an example of the functional configuration of the onboard apparatus 100. As the functional components, the onboard apparatus 100 includes a reservation information acquisition unit 11, a positional information acquisition unit 12, an event processing unit 13, a driving condition notification unit 14, a driving information memory 15, and a map information DB 16. In the map information DB 16, stored is the map information including map data having feature positions and POI information such as characters and pictures indicating properties of each point on the map data. The map information DB 16 may form a part of a vehicle navigation apparatus or the like mounted on the vehicle 10. Further, the map information may be provided from GIS connected to the network N1 or the support server 300. Those functional components are the functional components provided when the processor 101 of the onboard apparatus 100 executes various kinds of programs stored in the auxiliary memory 103. However, any one of the functional components or a part of the processing thereof may also be executed by a hardware circuit.

The reservation information acquisition unit 11 requests notification of ridesharing reservation information regarding the vehicle 10 to the support server 300 connected to the network N1 based on an operation input of the planned driver via the input unit 105. The reservation information acquisition unit 11 stores the acquired reservation information in the auxiliary memory 103. The reservation information stored in the auxiliary memory 103 is displayed on a display device of the display unit 104 in response to the operation input of the planned driver. The planned driver refers to the reservation information displayed on the display device, and identifies the traveling route to the destination related to ridesharing of the own vehicle. Identification of the traveling route to the destination is done by using the map information DB 16.

Note that the reservation information acquisition unit 11 may cooperate with the user terminal 200 of the planned driver via the communication unit 106B and acquire the reservation information notified to the user terminal. The planned driver riding on the vehicle 10 operates the user terminal 200 where the app is started, for example, to notify the reservation information of ridesharing registered with the reservation ID to the onboard apparatus 100. The reservation information acquisition unit 11 can acquire the reservation information notified from the user terminal 200 of the planned driver.

Further, the reservation information acquisition unit 11 identifies the ID of the persons on board (fellow-passenger ID, planned driver ID, and the like) included in the reservation information registered with the reservation ID, and acquires the information indicating the biometric patterns related to authentication of the persons on board from the support server 300. The reservation information acquisition unit 11 stores the acquired information indicating the biometric patterns related to authentication of the persons on board in the auxiliary memory 103. Note that the biometric patterns related to authentication of the persons on board will be described hereinafter by referring to a case of the fingerprint patterns.

The positional information acquisition unit 12 periodically acquires the positional information (for example, latitude and longitude) of the own vehicle detected by the positional information detection unit 107 by associating it with the time information. The acquired positional information is recorded in the driving information memory 15. Further, the positional information acquisition unit 12 acquires the positional information of the own vehicle in response to a request from the event processing unit 13 to be described later. The acquired positional information is recorded in the driving information memory 15 by being associated with the time information and the information identifying the driver identified via the event processing unit 13, for example. Further, the positional information is recorded in the driving information memory 15 by being associated with the time information and the fellow-passenger ID, the riding information, or the alighting information acquired via the event processing unit 13.

The event processing unit 13 detects change of the driver as well as riding and alighting of the fellow passenger to/from the vehicle 10. Then, when there is change of the driver, the event processing unit 13 reads out the biometric pattern related to authentication by the authentication sensor 108B based on existence of the driver sitting on the driver's seat captured via the in-vehicle camera 108A. Alternatively, the event processing unit 13 acquires the face image of the driver sitting on the driver's seat via the in-vehicle camera 108A. The event processing unit 13 notifies an acquisition request of the positional information to the positional information acquisition unit 12 along with at least one of the information of the face image of the driver captured by the in-vehicle camera 108A and the information indicating the biometric pattern related to authentication read out by the authentication sensor 108B. When the biometric pattern and the face image related to authentication are acquired via the reservation information acquisition unit 11, the ID (planned driver ID, fellow-passenger ID, or the like) of the driver identified by the authentication is identified. Note that identification of the ID of the driver (driver ID identification) by the biometric pattern acquired by the authentication sensor 108B may be done via the support server 300.

When there is riding and alighting of the fellow passenger to/from the vehicle 10, the event processing unit 13 acquires the fellow-passenger ID of the fellow passenger. The fellow passenger starts the app, for example, and notifies the fellow-passenger ID, the riding information, or the alighting information to the onboard apparatus 100 via the communication unit 206B of the user terminal 200. The event processing unit 13 acquires the fellow-passenger ID, the riding information, or the alighting information notified from the user terminal 200 via the communication unit 106B. Note that the planned driver may present the reservation information notified to the user terminal 200 of the fellow passenger presented, check consistency between the presented reservation information with the reservation information displayed on the display unit 104, and perform an operation for inputting of the fellow-passenger ID and riding/alighting of the fellow passenger. The event processing unit 13 notifies an acquisition request of the positional information to the positional information acquisition unit 12 along with the fellow-passenger ID. The positional information acquired via the positional information acquisition unit 12 is recorded in the driving information memory 15 by being associated with the time information, the fellow-passenger ID, the riding information or the alighting information.

The driving condition notification unit 14 notifies the history of the positional information recorded in the driving information memory 15 to the support server 300 regularly or in accordance with the events such as change of the driver and riding or alighting of the fellow passenger. The driving condition notification unit 14, for example, extracts the reservation ID from the reservation information acquired via the reservation information acquisition unit 11, and notifies the reservation ID to the support server 300 by associating with the history of the positional information recorded in the driving information memory 15.

(Flow of Processing: Onboard Apparatus)

Figure 9:
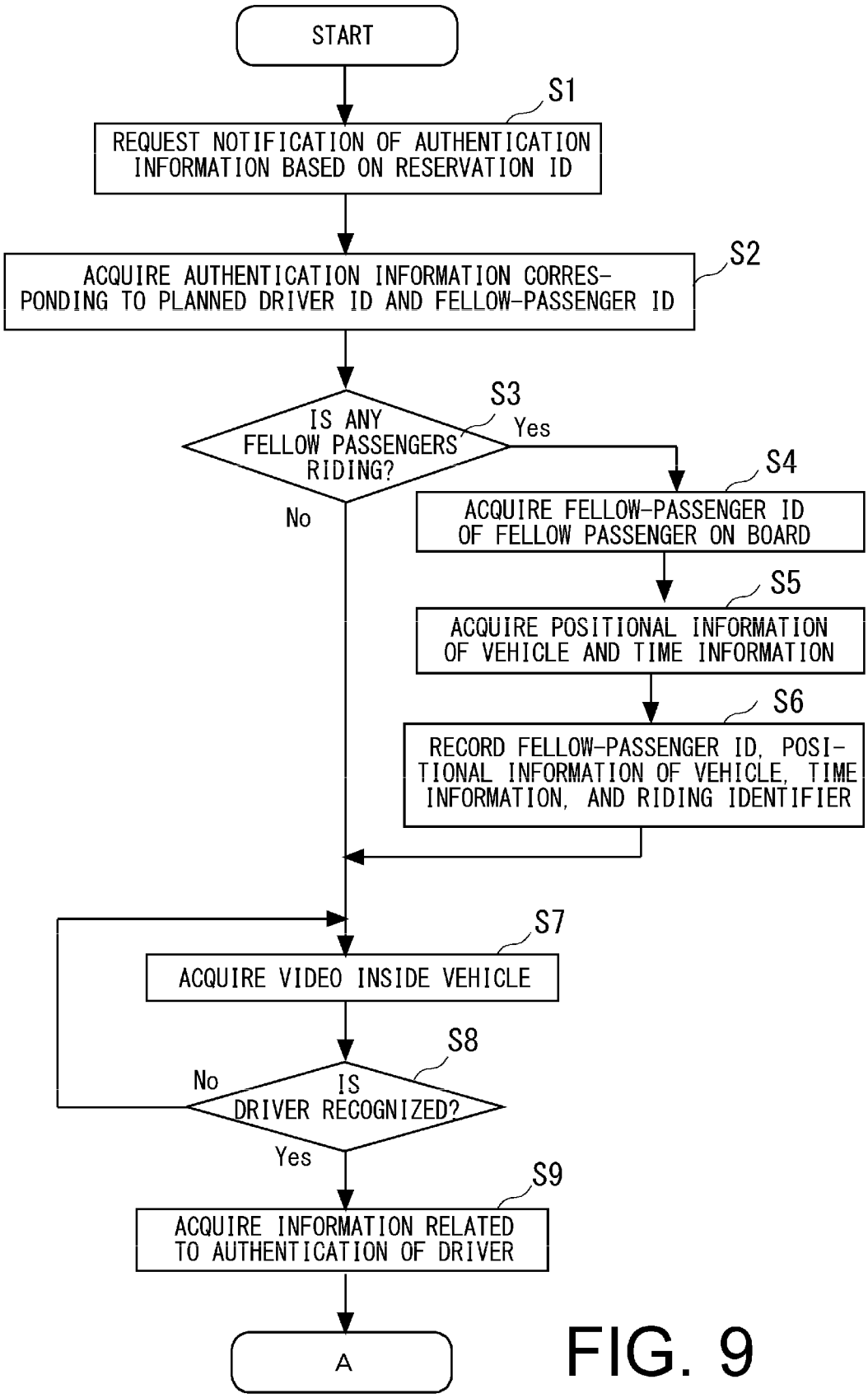
FIG. 9 is a flowchart illustrating an example of acquisition processing of positional information at start of traveling in ridesharing.
Figure 10:
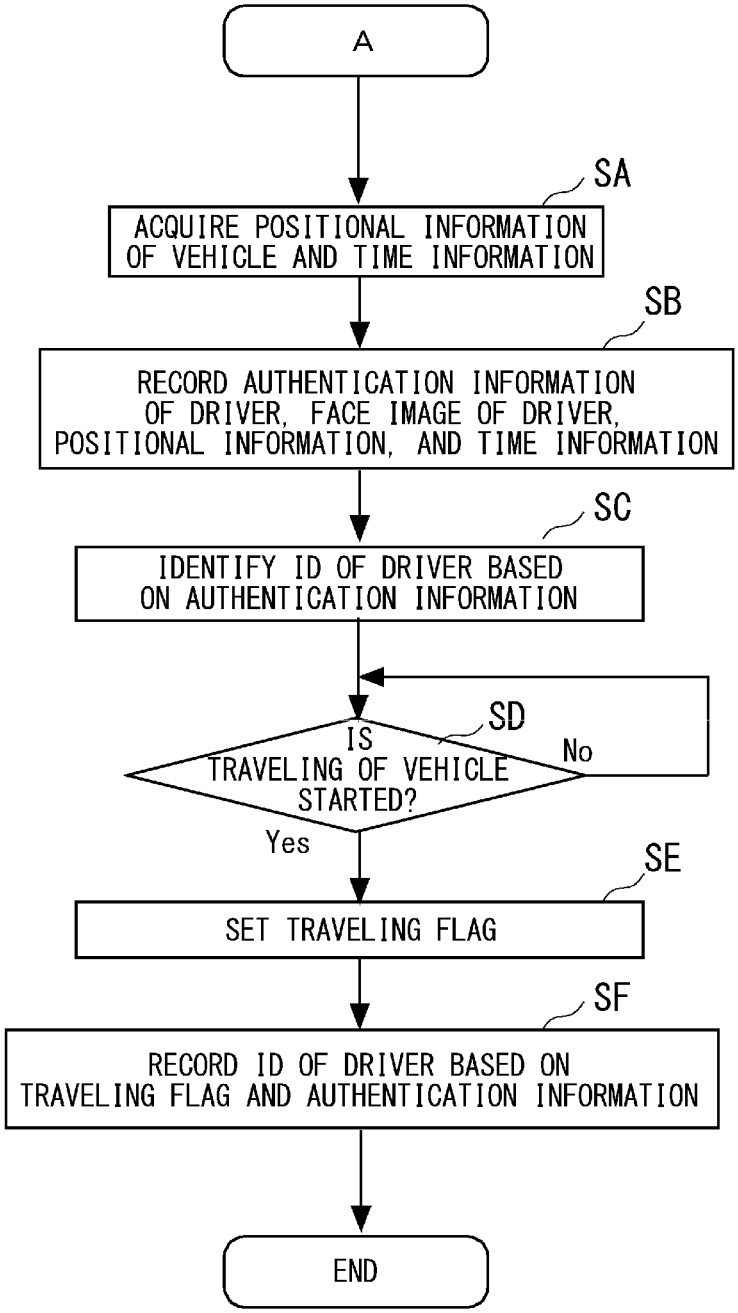
FIG. 10 is a flowchart illustrating an example of acquisition processing of positional information at start of traveling in ridesharing.

Next, processing of the onboard apparatus 100 according to the present embodiment will be described by referring to FIG. 9 to FIG. 14. FIG. 9 to FIG. 10 are flowcharts illustrating an example of acquisition processing of the positional information at the start of travelling (at the start of running) in ridesharing. The processing illustrated from FIG. 9 to FIG. 10 is an example of a mode that recognizes existence of the driver sitting on the driver's seat by the in-vehicle camera 108A, and identifies the driver based on the authentication information such as the fingerprint pattern or the like of the recognized driver. Note that the onboard apparatus 100 associates and records the authentication information and the face image and, as will be described by referring to FIG. 11 to FIG. 13, and detects change of the driver based on the face image.

In the flowchart of FIG. 9, illustrated as the start of processing is when the vehicle 10 registered with the reservation information with the reservation ID starts the engine at the start of travelling for ridesharing. The planned driver of the vehicle 10 performs an input operation via the input unit 105 of the onboard apparatus 100, for example, after the start of the engine to acquire the reservation information regarding the reservation ID through the support server 300 connected to the network N1. Alternatively, the planned driver operates the user terminal 200 where the app is started, for example, to notify the reservation information of ridesharing registered with the reservation ID via the communication unit 106B to the onboard apparatus 100.

The onboard apparatus 100 makes a request to the support server 300 for notifying the authentication information (fingerprint patterns or the like) corresponding to the planned driver ID and the fellow-passenger ID included in the reservation information registered with the reservation ID (S1). The support server 300 refers to the planned driver information DB 34, for example, extracts the authentication information corresponding to the planned driver ID and the fellow-passenger ID, and notifies such information to the onboard apparatus 100. The onboard apparatus 100 acquires the authentication information corresponding to the planned driver ID and the fellow-passenger ID notified from the support server 300 (S2). The onboard apparatus 100 stores the acquired authentication information in the auxiliary memory 103 by associating it with the reservation ID. Through the processing of S1 to S2, the authentication information for identifying the driver driving the vehicle 10 is acquired. The onboard apparatus 100 can identify the driver driving the vehicle by comparing the authentication information corresponding to the planned driver ID and the fellow-passenger ID acquired through the above processing with the pattern or the like indicating the biological information read out via the authentication sensor 108B. After the processing of S2, the processing shifts to S3.

The onboard apparatus 100 determines whether or not there is a ride of a fellow passenger (S3). Whether or not there is a ride of a fellow passenger on the vehicle 10 is determined by the notification of the information regarding the ride from the user terminal 200 of the fellow passenger or the input operation of the information done by the planned driver regarding the ride of the fellow passenger. The fellow passenger planning to ride on the vehicle 10 communicates with the onboard apparatus 100 at the time of riding on the vehicle by operating the user terminal 200 where the app is started up, for example. The onboard apparatus 100 receives the fellow-passenger ID and a riding notification from the user terminal 200 via the communication unit 106B. When the received fellow-passenger ID matches the fellow-passenger ID registered with the reservation information, for example, the onboard apparatus 100 settles the received riding notification and determines that there is a ride on the vehicle 10. Further, when there is an input operation of the fellow-passenger ID and a ride on the vehicle via the input unit 105, the onboard apparatus 100 determines that there is a ride on the vehicle 10.

The onboard apparatus 100 shifts to processing of S4 when determining that there is a ride of the fellow passenger on the vehicle ("Yes" in S3). In the meantime, when determining that there is no ride of the fellow passenger in the vehicle ("No" in S3), the onboard apparatus shifts to processing of S7.

In the processing of S4, the onboard apparatus 100 acquires the fellow-passenger ID of the fellow passenger riding on the vehicle. The onboard apparatus 100 acquires the positional information of the own vehicle detected by the positional information detection unit 107 by associating it with the time information (S5). Then, the onboard apparatus 100 records the acquired fellow-passenger ID, positional information, and time information in the driving information memory 15 by associating them with an identifier indicating a ride on the vehicle (riding identifier) (S6), and shifts to the processing of S7. Note here that the identifier indicating a ride on the vehicle may be information expressed by binary statuses such as an inactive state and an active state. For example, when there is a ride on the vehicle, the onboard apparatus 100 sets the status of the identifier indicating a ride on the vehicle to an active state.

In the processing of S7, the onboard apparatus 100 acquires a video inside the vehicle. Then, the onboard apparatus 100 determines existence of the driver sitting on the driver's seat based on the acquired video inside the vehicle (S8). When determining by pattern matching or the like that the driver is not captured to be identifiable in the video inside the vehicle ("No" in S8), the onboard apparatus 100 shifts to the processing of S7. In the meantime, when determining by pattern matching or the like that the driver sitting on the driver's seat is captured to be identifiable ("Yes" in S8), the onboard apparatus 100 shifts to processing of S9. Note that when the driver sitting on the driver's seat is captured to be identifiable, the face image of the recognized driver is acquired.

In the processing of S9, the onboard apparatus 100 acquires the information related to authentication of the driver sitting on the driver's seat. The onboard apparatus 100 informs to have the fingerprint or the like read out via the authentication sensor 108B, for example. The onboard apparatus 100 displays a message prompting to read out the fingerprint or the like on the display device of the display unit 104, for example. Also, the onboard apparatus 100 may inform the driver of a voice message prompting to read out the fingerprint or the like via a speaker or the like included in the display unit 104. In response to the message or the like informed via the display unit 104, the driver touches authentication sensor 108B by the thumb or the index finger, for example, for allowing the fingerprint or the like for identifying the driver oneself to read out. The onboard apparatus 100 acquires the biological information related to authentication of the fingerprint or the like read out via the authentication sensor 108B.

In the flowchart of FIG. 10, the onboard apparatus 100 acquires the positional information and the time information of the vehicle 10 at the current point (SA). Then, the onboard apparatus 100 associates and records the authentication information of the driver acquired via the authentication sensor 108B, the face image of the driver captured by the in-vehicle camera 108A, the positional information and the time information of the vehicle 10 in the driving information memory 15 (SB). Note that the face image of the driver is also used for detecting change of the driver when stop of the vehicle 10 is detected, as will be described later.

The onboard apparatus 100 identifies the ID (planned driver ID, fellow-passenger ID) of the driver sitting on the driver's seat based on the authentication information of the driver acquired via the authentication sensor 108B (SC). The onboard apparatus 100 compares the authentication information corresponding to the planned driver ID and the fellow-passenger ID acquired via the support server 300 with the authentication information acquired via the authentication sensor 108B to identify the ID of the driver sitting on the driver's seat.

Note that there may be a case where the authentication information of the fellow passenger riding on the vehicle 10 is not registered in the planned driver information DB 34. That is, it is a case where there is no actual driving record of the driver (fellow passenger) sitting on the driver's seat of the vehicle 10. In such case, however, it is possible to identify that the driver (driver whose authentication information is read out) sitting on the driver's seat is other than the planned driver at least based on the authentication information of the planned driver notified from the support server 300.

The onboard apparatus 100 may display the face image of the driver recorded in the processing of SB on the display device of the display unit 104, and display a message prompting an input of the fellow-passenger ID corresponding to the face image. Then, the onboard apparatus 100 may identify the ID of the driver sitting on the driver's seat based on the ID information (fellow-passenger ID) via the input unit 105. Note that the onboard apparatus 100 can distinguish the driver by temporarily giving an identification number or the like indicating that the driver is other than the planned driver to the authentication information acquired via the authentication sensor 108B. The onboard apparatus 100 can identify the ID of the driver by displaying the face image corresponding to the identification number on the display unit 104 after the start of traveling of the vehicle 10 to prompt the input of the fellow-passenger ID corresponding to the face image.

In the processing of SD, the onboard apparatus 100 determines whether or not traveling of the vehicle 10 is started. The start of traveling of the vehicle 10 is determined by the vehicle state detection unit 109, for example. For example, when the vehicle speed detected via the vehicle speed sensor 109A exceeds 0 km/h, the onboard apparatus 100 determines that traveling of the vehicle is started. Note that the onboard apparatus 100 may add the fact that the transmission state detected by the transmission detection sensor 109B is in the drive mode "D" to the determination condition. Further, the onboard apparatus 100 may add the fact that the parking brake state detected by the parking brake detection sensor 109C is the off-state to the determination condition.

When determining that traveling of the vehicle 10 is started ("Yes" in SD), the onboard apparatus 100 shifts to processing of SE. In the meantime, when determining that traveling of the vehicle 10 is not started ("No" in SD), the onboard apparatus 100 repeats the processing of SD.

In the processing of SE, the onboard apparatus 100 sets a traveling flag that indicates a state of being traveling by ridesharing. Note here that the traveling flag is information expressed by binary statuses such as an inactive state and an active state, for example. The onboard apparatus 100 sets the status of the traveling flag to an active state, for example, and shifts to processing of SF.

In the processing of SF, the onboard apparatus 100 associates and records the traveling flag set to an active state and the ID (planned driver ID, fellow-passenger ID) of the driver identified by the authentication information. Such information is temporarily stored in a prescribed area of the main memory 102, for example. Note that when the ID of the driver is unidentified, the temporarily given identification number or the like is recorded by being associated with the traveling flag. After the processing of SF, the processing of FIG. 9 to FIG. 10 is ended. With the vehicle 10, traveling is started on the route reaching the destination point via a planned riding point and a planned alighting point of each fellow passenger. In the vehicle 10 after the start of traveling, the temporarily given identification number is updated to the ID of the identified driver at an appropriate timing.

Through the above processing, the onboard apparatus 100 can detect the driver at the time of the start of running by ridesharing. The ID (planned driver ID, fellow-passenger ID) of the detected driver can be identified based on the authentication information. Then, the onboard apparatus 100 can associate and record the information (face image, authentication information) for identifying the driver, the positional information, and the time information. The onboard apparatus 100 can associate and record the information regarding the driver at the time of the start of running by ridesharing and the information as the starting point of measurement of the passage information.

Further, the onboard apparatus 100 can at least distinguish the driver other than the planned driver by giving the identification number or the like. The onboard apparatus 100 can associate the information (face image, authentication information) for identifying the driver, the positional information and the time information along with the identification number or the like given to the driver to be recorded. The onboard apparatus 100 can associate and record the traveling flag indicating that the vehicle 10 is traveling along with the ID of the identified driver or the temporal identification number or the like. The temporarily given identification number or the like can be updated to the ID (fellow-passenger ID) for identifying the driver at an appropriate timing after the start of traveling. The onboard apparatus 100 becomes capable of detecting change of the driver after the start of running based on the information recorded at the start of running and the traveling flag.

Note that when the face images corresponding to the planned driver ID and the fellow-passenger ID included in the reservation information registered with the reservation ID can be acquired as the authentication information in the processing of S1, the onboard apparatus 100 can identify the driver by comparison with the face images. The onboard apparatus 100 may compare the face image of the driver captured via the in-vehicle camera 108A with the face image notified from the support server 300 to identify the ID (planned driver ID, fellow-passenger ID) of the driver (FIG. 10, SC). In such case, the processing illustrated in S9 of FIG. 9 can be omitted.

Further, with the vehicle having no in-vehicle camera 108A mounted thereon or in the onboard apparatus 100 not using the in-vehicle camera 108A, the ID (planned driver ID, fellow-passenger ID) of the driver of the vehicle 10 may be identified merely with the authentication information of the driver read out by the authentication sensor 108B. Examples of such case may be a mode where a fingerprint sensor or the like is placed at an operation component such as a shift lever or a steering wheel that is operated without exception when driving and a mode where an iris recognition sensor is provided in a meter panel. In such cases, the processing illustrated in S7 to S8 of FIG. 9 can be omitted.

Figure 11:
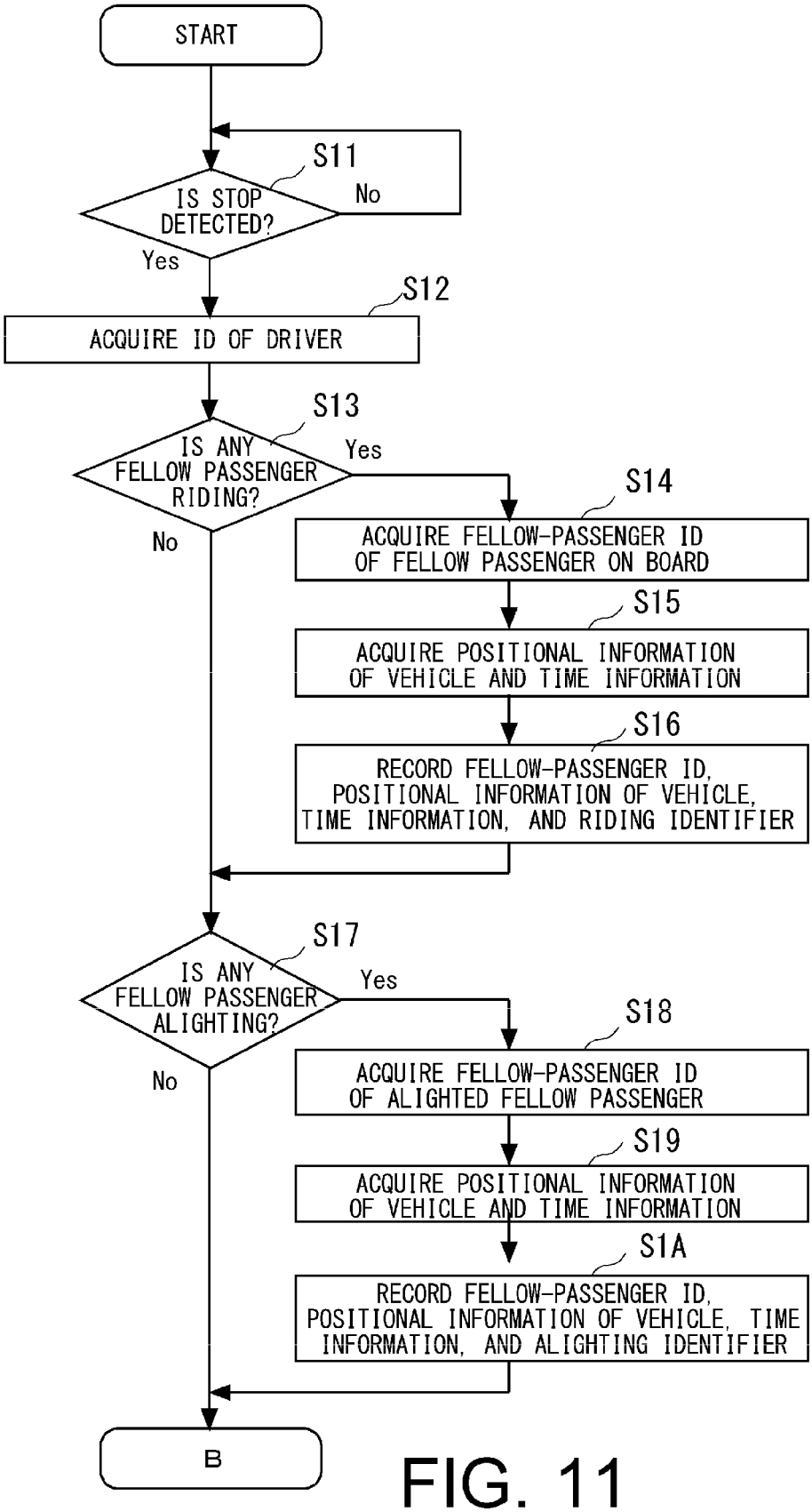
FIG. 11 is a flowchart illustrating an example of processing at the time of occurrence of events.
Figure 12:
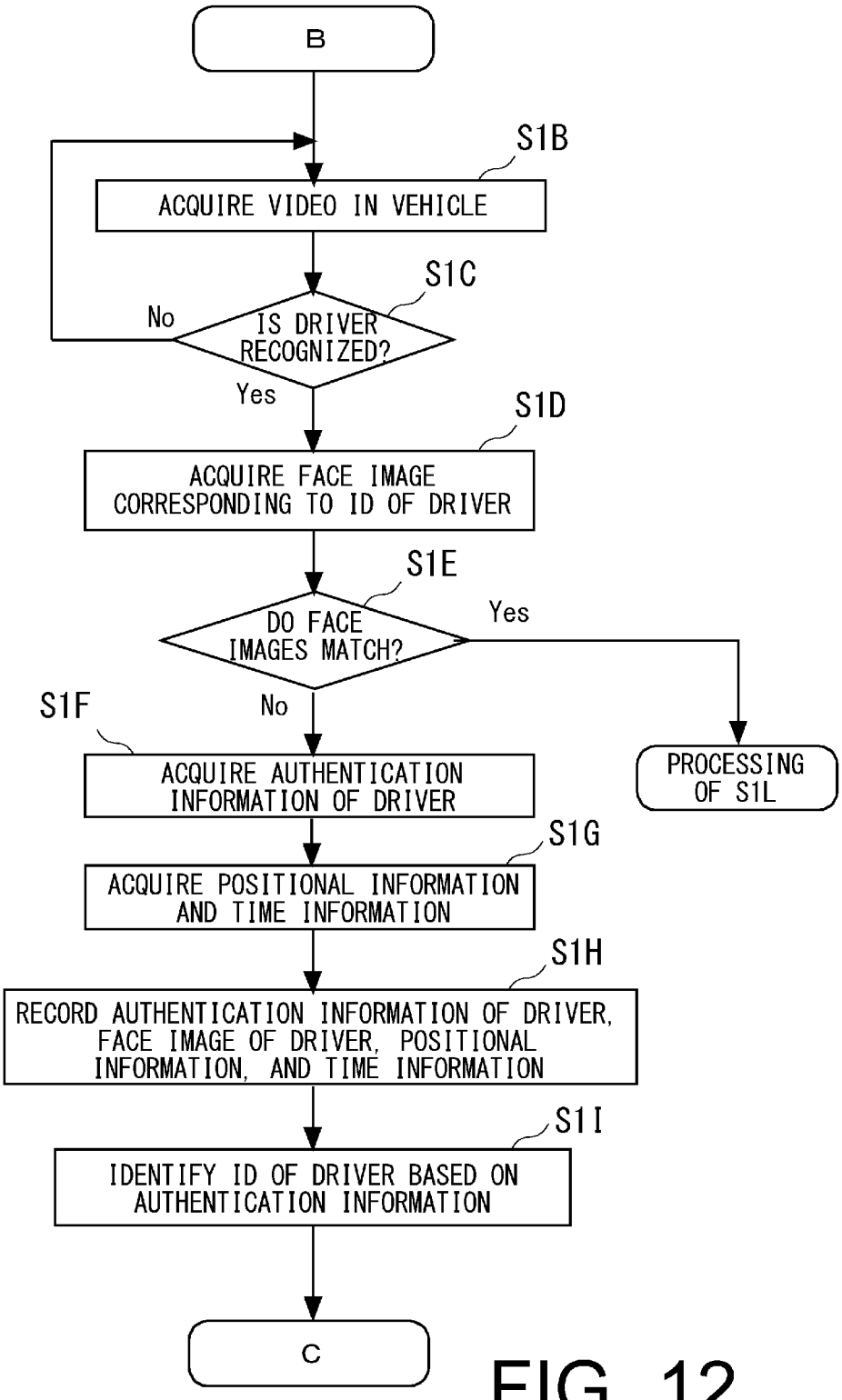
FIG. 12 is a flowchart illustrating an example of processing at the time of occurrence of events.
Figure 13:
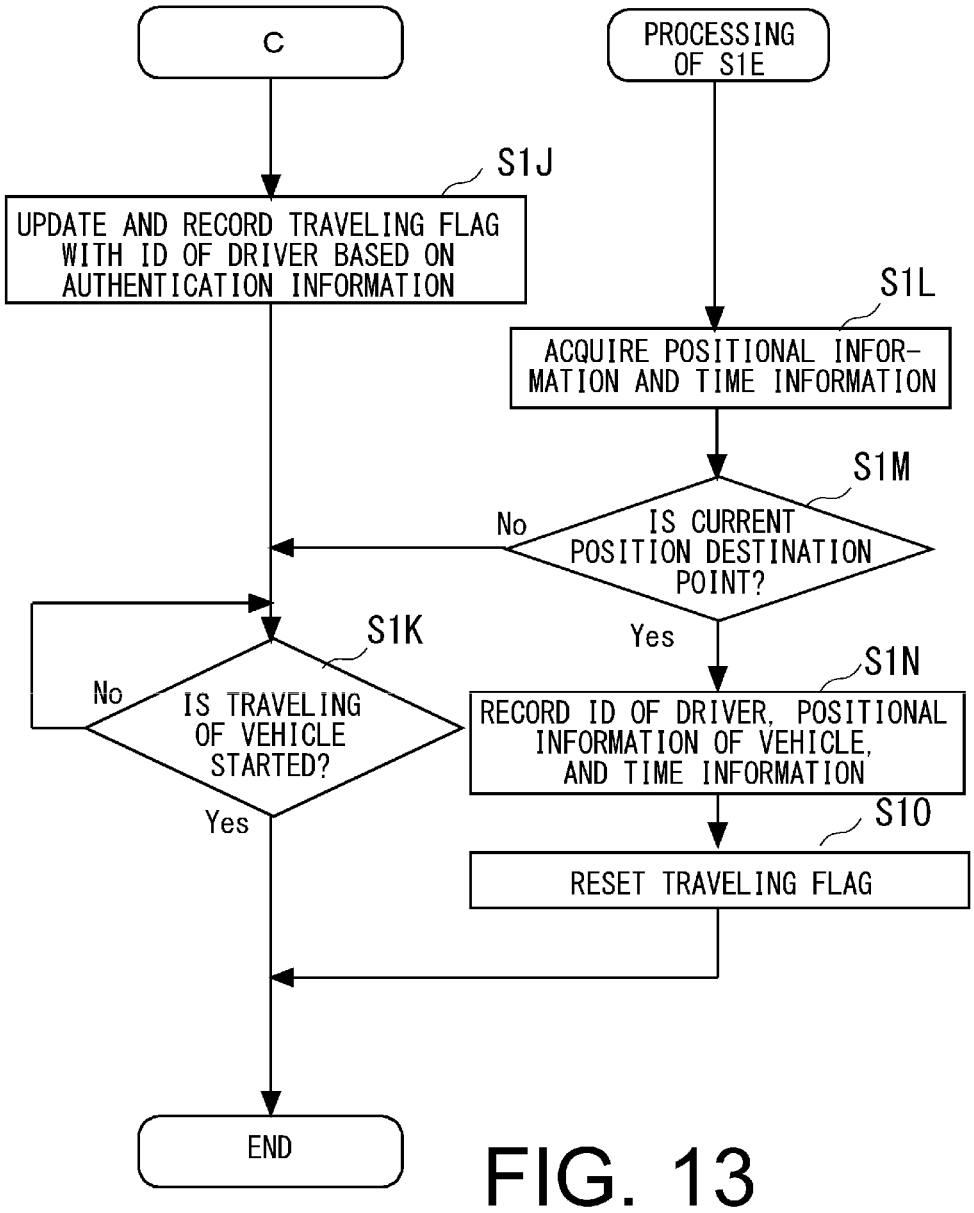
FIG. 13 is a flowchart illustrating an example of processing at the time of occurrence of events.

Next, processing at the time of occurrence of events of the onboard apparatus 100 will be described by referring to FIG. 11 to FIG. 13. FIG. 11 to FIG. 13 are flowcharts illustrating an example of the processing at the time of occurrence of the events. The processing of FIG. 11 to FIG. 13 is executed when the status of the traveling flag is in an active state, i.e., during a period until reaching the destination point registered in the reservation information with the reservation ID from the departure point of the vehicle 10. Through the processing of FIG. 11 to FIG. 13, the information regarding change of the driver and stopping events occurring in accordance with riding and alighting of the fellow passenger is recorded along with the positional information and the time information. The processing illustrated in FIG. 11 to FIG. 13 is an example of a mode that recognizes existence of the driver sitting on the driver's seat by the in-vehicle camera 108A and identifies the driver based on the authentication information such as the fingerprint pattern or the like of the recognized driver.

In the flowchart of FIG. 11, start of processing is illustrated as the time when setting the active state of the traveling flag. The onboard apparatus 100 detects stop of the vehicle 10 that is started to travel in ridesharing (S11). Stop of the vehicle 10 is detected by the vehicle state detection unit 109, for example. The onboard apparatus 100 detects stop by taking the fact that the vehicle speed detected via the vehicle speed sensor 109A, for example, is 0 km/h or less as the condition. Note that the onboard apparatus 100 may add the fact that the transmission state detected by the transmission detection sensor 109B is in a stop mode "N" or "P" to the determination condition. Further, the onboard apparatus 100 may add the fact that the parking brake state detected by the parking brake detection sensor 109C is an on-state to the determination condition. The reason is that it can be assumed that the vehicle 10 is in a stop state when riding or alighting of the fellow passenger or change of the driver takes place.

When stop of the vehicle 10 is detected ("Yes" in S11), the onboard apparatus 100 shifts to processing of S12. In the meantime, when stop of the vehicle 10 is not detected ("No" in S11), the onboard apparatus 100 repeats the processing of S11. The onboard apparatus 100 acquires the ID (or the identification number in an estimated state) of the driver at the current point recorded by being associated with the traveling flag (S12). The onboard apparatus 100 temporarily stores the acquired information in a prescribed area of the main memory 102, and shifts to processing of S13.

In the processing of S13, the onboard apparatus 100 determines whether or not there is a ride of a fellow passenger. The processing of S13 is similar to the processing of S3, so that explanations thereof are omitted. When determining that there is a ride of a fellow passenger ("Yes" in S13), the onboard apparatus 100 shifts to processing of S14. In the meantime, when determining that there is no ride of a fellow passenger ("No" in S13), the onboard apparatus 100 shifts to processing of S17.

The processing of S14 to S16 is similar to the processing of S3 to S5, so that explanations thereof are omitted. The onboard apparatus 100 records the acquired fellow-passenger ID, the positional information, and the time information in the driving information memory 15 by associating them with the identifier (riding identifier) (S16), and shifts to the processing of S17.

In the processing of S17, the onboard apparatus determines whether or not there is alighting of the fellow passenger. Whether or not there is alighting of the fellow passenger is determined by notification of the information regarding alighting from the user terminal 200 of the fellow passenger inside the vehicle or an input operation of the information done by the planned driver regarding alighting of the fellow passenger. Determining whether or not there is alighting of the fellow passenger from the vehicle is done in a similar manner to the case of determining whether or not there is a ride on the vehicle, so that explanations are omitted.

When determining that there is no alighting of the fellow passenger ("No" in S17), the onboard apparatus 100 shifts to processing of S1B of FIG. 12. In the meantime, when determined that there is alighting of the fellow passenger from the vehicle ("Yes" in S7), the onboard apparatus 100 shifts to processing of S18 and acquires the fellow-passenger ID of the fellow passenger alighted from the vehicle 10. Then, the onboard apparatus 100 acquires the positional information of the own vehicle by associating it with the time information (S19), and records the acquired fellow-passenger ID, positional information, and time information in the driving information memory 15 by associating them with an identifier indicating alighting of the vehicle (alighting identifier) (S1A). The identifier indicating alighting of the vehicle is similar to the identifier indicating a ride. When there is alighting of the vehicle, for example, the onboard apparatus 100 sets the status of the identifier indicating alighting of the vehicle to an active state. The processing is shifted to processing of S1B of FIG. 12.

In the processing of S1B in the flowchart of FIG. 12, the onboard apparatus 100 acquires the video inside the vehicle. Then, the onboard apparatus 100 determines existence of the driver sitting on the driver's seat based on the acquired video inside the vehicle (S1C). The processing of S1C is similar to the processing of S8, so that explanations thereof are omitted. When determining by pattern matching or the like that the driver is not captured to be identifiable in the video inside the vehicle ("No" in S1C), for example, the onboard apparatus 100 shifts to the processing of S1B. In the meantime, when determining by pattern matching or the like that the driver sitting on the driver's seat is captured to be identifiable ("Yes" in SIC), the onboard apparatus 100 shifts to processing of S1D. Note that when the driver sitting on the driver's seat is captured to be identifiable, the face image of the recognized driver at the current point is acquired.

In the processing of S1D, the onboard apparatus 100 acquires the face image corresponding to the ID of the driver at the point of detecting stop of the vehicle 10. Then, in the processing of S1E, the onboard apparatus 100 compares the face image corresponding to the ID of the driver at the point of detecting stop of the vehicle 10 with the face image of the driver at the current point recognized in the processing of SIC. When both face images match (in a case of high matching degree) ("Yes" in S1E), the onboard apparatus 100 shifts to processing of S1L of FIG. 13. In the meantime, when both face images do not match (in a case of low matching degree) ("No" in S1E), the onboard apparatus 100 shifts to processing of S1F. Through the processing of S1D to S1E, change of the driver done by stopping the vehicle 10 is detected.

In the processing of S1F, the onboard apparatus 100 acquires the information related to authentication of the driver sitting on the driver's seat. The onboard apparatus 100 informs to read the fingerprint or the like via the authentication sensor 108B, for example. Then, the onboard apparatus 100 acquires biological information related to authentication of the fingerprint or the like read out via the authentication sensor 108B. After acquiring the biological information, the processing shifts to S1G. As described by referring to FIG. 9 to FIG. 10, detection of the driver may be done using either the face image of the driver captured by the in-vehicle camera 108A or the biological information of the driver acquired via the authentication sensor 108B.

In the processing of S1G, the onboard apparatus 100 acquires the positional information and the time information of the vehicle 10 at the current point. Then, the onboard apparatus 100 associates and records the authentication information of the driver at the current point acquired via the authentication sensor 108B, the face image of the driver at the current point captured by the in-vehicle camera 108A, the positional information and the time information of the vehicle 10 in the driving information memory 15 (S1H). Through the processing of S1F to S1H, the information for identifying the driver after change is recorded.

The onboard apparatus 100 identifies the ID (planned driver ID, fellow-passenger ID) of the driver sitting on the driver's seat based on the authentication information of the driver acquired via the authentication sensor 108B (S11). The onboard apparatus 100 compares the authentication information corresponding to the planned driver ID and the fellow-passenger ID acquired via the support server 300 with the authentication information acquired via the authentication sensor 108B, for example, to identify the ID of the driver. Note that when the authentication information acquired via the authentication sensor 108B is assumed to be of the fellow passenger other than the planned driver, the onboard apparatus 100 gives an identification number indicating such assumption to distinguish the driver. Note that the onboard apparatus 100 may identify the ID of the driver sitting on the driver's seat based on the face image of the driver captured by the in-vehicle camera 108A.

In processing of S1J in the flowchart of FIG. 13, the onboard apparatus 100 updates the ID information of the driver before the change associated with the traveling flag with the ID of the driver after the change. The information after being updated is stored in a prescribed area of the main memory 102.

The onboard apparatus 100 determines whether or not traveling of the vehicle 10 that is detected to be stopped is started (S1K). The start of traveling of the vehicle 10 is determined by the vehicle state detection unit 109. For example, when the vehicle speed detected via the vehicle speed sensor 109A exceeds 0 km/h, the onboard apparatus 100 determines that traveling of the vehicle is started. Note that the onboard apparatus 100 may add the fact that the transmission state detected by the transmission detection sensor 109B is a drive mode "D" to the determination condition. Further, the onboard apparatus 100 may add the fact that the parking brake state detected by the parking brake detection sensor 109C is the off-state to the determination condition.

When determining that traveling of the vehicle 10 that is detected to be stopped is started ("Yes" in S1K), the onboard apparatus 100 ends the processing illustrated in FIG. 11 to FIG. 13. In the meantime, when traveling of the vehicle 10 is not started ("No" in S1K), the onboard apparatus 100 repeats the processing.

In processing of S1L, the onboard apparatus 100 acquires the positional information and the time information at the current point where stop is detected. Then, the onboard apparatus 100 determines whether or not the current position of the vehicle 10 is the destination point of ridesharing (S1M). When the positional information acquired in the processing of S1L matches the destination point registered in the reservation information, for example, the onboard apparatus 100 determines that the current position of the vehicle 10 is the destination point. Note that matching of the destination point registered in the reservation information and the positional information acquired in the processing of SB is done by referring to the map information DB 16. When the current position of the vehicle 10 is not the destination point ("No" in S1M), the onboard apparatus 100 shifts to processing of S1K. In the meantime, when the current position of the vehicle 10 is the destination point ("Yes" in S1M), the onboard apparatus 100 shifts to processing of S1N.

In the processing of S1N, the onboard apparatus 100 associates and records the ID (or the identification number indicating assumption) of the driver and the positional information as well as the time information of the vehicle 10 acquired in the processing of S1L in the driving information memory 15. Then, the onboard apparatus 100 resets the traveling flag indicating traveling of the vehicle 10 by ridesharing (S10). Through the processing of S10, the status of the traveling flag set to an active state in the processing of SE at the start of traveling by ridesharing is reset to an inactive state. After the processing of S10, the processing of FIG. 11 to FIG. 13 is ended.

Through the above processing, the onboard apparatus 100 can detect the vehicle 10 whose traveling flag status is set to an active state, i.e., can detect stop of the vehicle 10 that is started to travel by ridesharing. When there is an event including riding or alighting of the fellow passenger occurring when the vehicle 10 is being stopped, the onboard apparatus 100 can record the information such as the fellow-passenger ID of the fellow passenger, identifiers for identifying riding and alighting, and the like by associating it with the positional information and the time information of the vehicle 10 that is stopped. Further, when the positional information at the time of stop corresponds to the destination point, the onboard apparatus 100 can record the ID of the driver recorded as the driver immediately before stop by associating it with the positional information and the time information at the time of stop.

Further, when there is a stopping event occurring due to change of the driver, the onboard apparatus 100 can compare the face images of the driver before the stop and the driver after the stop based on the face image information of the driver sitting on the driver's seat. Then, when the face images of the driver before the stop and the driver after the stop are different, the onboard apparatus 100 can acquire the face image information, the authentication information, and the like of the driver after the change, and associate and record the positional information and the time information of the vehicle 10 that is stopped.

Note that when the vehicle 10 after stop continues to travel by ridesharing, the onboard apparatus 100 can update the ID of the driver associated with the traveling flag by the ID or the like based on the authentication information of the driver after the change. The onboard apparatus 100 can identify the driver driving the vehicle 10 continuing to travel by ridesharing after the start of running based on the updated ID of the driver.

Figure 14:
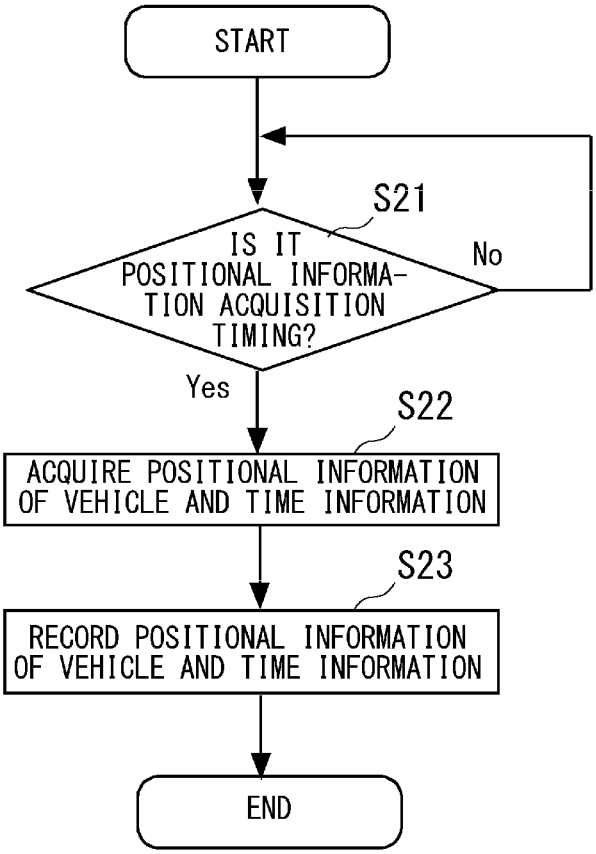
FIG. 14 is a flowchart illustrating an example of acquisition processing of positional information of a vehicle while traveling.

Next, the processing of FIG. 14 will be described. FIG. 14 is a flowchart illustrating an example of acquisition processing of the positional information of the traveling vehicle 10. The processing of FIG. 14 is executed regularly during a period where the status of the traveling flag is in an active state. Through the processing of FIG. 14, the positional information and the time information of the vehicle 10 while traveling on the route can be recorded.

In the flowchart of FIG. 14, the onboard apparatus 100 determines whether or not it is a regular, periodic acquisition timing of the positional information (S21). The determination is made based on whether or not a timing signal (trigger signal) for acquiring the positional information is in an active state, for example. When the timing signal is in an active state, the onboard apparatus 100 determines as being the regular acquisition timing of the positional information. When it is the regular, periodic acquisition timing of the positional information ("Yes" in S21), the onboard apparatus 100 shifts to processing of S22. In the meantime, when it is not the regular, periodic acquisition timing of the positional information ("No" in S21), the onboard apparatus 100 repeats the processing of S21.

In the processing of S22, the onboard apparatus 100 acquires the current positional information of the vehicle 10 detected by the positional information detection unit 107 by associating it with the time information. Then, the onboard apparatus 100 records the acquired positional information and the time information in the driving information memory 15 (S23). After the processing of S23, the processing of FIG. 14 is ended.

Through the above processing, the onboard apparatus 100 can record, as the history, the positional information of the vehicle 10 acquired periodically at the time of traveling on the route until reaching the destination registered with the reservation information with the reservation ID. The onboard apparatus 100 can extract the history of the positional information recorded in the driving information memory 15 at an arbitrary timing as appropriate, and notify the extracted history of the positional information to the support server 300 connected to the network N1 via the communication unit 106A. Note that the extracted history of the positional information is transmitted to the support server 300 along with the reservation ID and the identification information of the onboard apparatus 100.

(Flow of Processing: Support Server)

Figure 15:
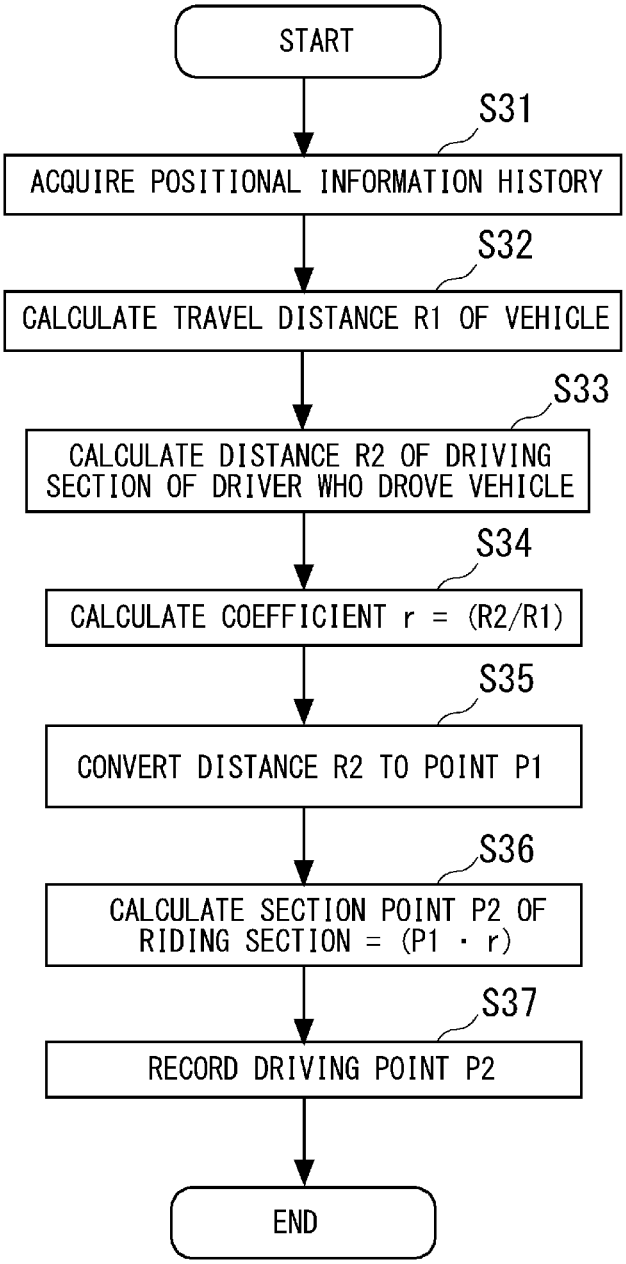
FIG. 15 is a flowchart illustrating an example of calculation processing of points according to running distance of a driving section.

Next, by referring to FIG. 15 to FIG. 16, processing of the support server 300 according to the present embodiment will be described. FIG. 15 is a flowchart illustrating an example of calculation processing of the points according to the running distance of the riding sections. Through the processing of FIG. 15, points according to the running distance of the driver who drove the vehicle 10 are calculated. Note that the processing of FIG. 15 is executed for each of the persons on board (planned driver, fellow passenger) registered in the reservation information with the reservation ID.

In the flowchart of FIG. 15, illustrated as the start of processing is when receiving a point calculation request notified from the onboard apparatus 100. The onboard apparatus 100 notifies the point calculation request including the identification information of the apparatus itself and the reservation ID to the support server 300. The support server 300 searches the ridesharing management DB 38 using the received reservation ID as a search key to identify the route traveling information table corresponding to the reservation ID.

The support server 300 acquires the positional information history from the identified route traveling information table (S31). The support server 300 acquires the positional information history from the departure point of the vehicle 10 until reaching the destination. In the case of FIG. 1, acquired is the positional information history recorded from the point d until reaching the point e. The acquired positional information history is temporarily stored in a prescribed area of the main memory 302. In the explanations hereinafter, the explanatory diagram of FIG. 1 for describing ridesharing and the route traveling information table of FIG. 6 are used as an explanation example as appropriate.

In processing of S32, the support server 300 calculates travel distance R1 of the vehicle 10 based on the acquired positional information history. The support server 300 refers to the map information DB 37, for example, and identifies the traveling route from the departure point of the vehicle 10 until reaching the destination indicated in the positional information history. Referring to FIG. 1, for example, identified is the traveling route from the point d to the point e via the riding section of the user B (from the point f to the point g) and the riding section of the user C (from the point h to the point e). The support server 300 calculates the travel distance R1 from the identified traveling route and the map data of the map information DB 37. Through the processing of S32, the total travel distance of the vehicle 10 for ridesharing registered with the reservation ID is identified. The calculated travel distance R1 is forwarded to processing of S34.

In the processing of S33, the support server 300 calculates distance R2 of the driving section of the vehicle 10 by the person onboard as the processing target. The support server 300 extracts the positional information history corresponding to the person on board as the processing target based on the ID of the driver recorded in the history of the positional information, for example. Then, the support server 300 refers to the map information DB 37 in a similar manner to the processing of S32 to identify the route corresponding to the extracted positional information history as the driving section of the person on board. Then, the support server 300 calculates the distance R2 from the identified route and the map data of the map information DB 37.

Note that when there are a plurality of driving sections of the processing target based on the ID of the driver recorded in the history of the positional information, the distance of each of the driving sections may be calculated and added to acquire the distance R2. Through the processing of S33, the travel distance (driving distance of the processing target) of the driving section corresponding to the ID of the driver recorded in the history of the positional information is calculated. The calculated distance R2 is forwarded to processing of S34.

In the processing of S34, the support server 300 calculates "coefficient r=(R2/R1)" based on the forwarded travel distance R1 and distance R2. Through the processing of S34, the coefficient r indicating a ratio of the driving distance of the processing target with respect to the total driving distance of ridesharing is calculated. The calculated coefficient r is forwarded to processing of S36.

In processing of S35, the support server 300 converts the distance R2 driven by the processing target to a point P1. The support server 300 converts the distance R2 to the point by using a point conversion coefficient per unit distance defined in advance, for example. For example, in a case where it is defined to give 1 point by taking 100 m as a unit distance, the distance R2 of 10 km is converted to 100 points. Through the processing of S35, points corresponding to the distance of the driving section traveled by ridesharing by driving of the processing target are calculated. The calculated point P1 is forwarded to the processing of S36.

In the processing of S36, the support server 300 multiplies the forwarded point P1 and the coefficient r to calculate a driving point P2=(P1×r). Through the processing of S36, driving points allotted according to the ratio of the running distance of the driving section driven by the processing target with respect to the total travel distance from the departure point to the destination point are calculated. The support server 300 records the calculated driving point P2 in the ridesharing management DB 38 (S37). The driving point P2 is stored in the running distance sub-field of the point management information table. After the processing of S37, the processing illustrated in FIG. 15 is ended.

Through the above processing, the support server 300 can identify the traveling route from the departure point of the vehicle 10 until reaching the destination via the riding point and alighting point of the fellow passenger based on the positional information notified from the onboard apparatus 100. Then, the support server 300 can identify the driving section of each of the processing targets based on the identification information (ID) for identifying the driver recorded in the history of the positional information. That is, the support server 300 can identify the passage information for the driver at the start of running of the vehicle 10 traveled by ridesharing and for each of the drivers changed after the start of running. Note that the drivers recorded in the history of the positional information are the planned driver and the fellow passenger registered in the reservation information with the reservation ID.

Further, the support server 300 can calculate the distance of the route regarding the driving section and calculate the points corresponding to the distance. The support server 300 can calculate the driving points for each of the drivers by reflecting the ratio of the distance of the driving section with respect to the total travel distance from the departure point to the destination point of the vehicle 10 traveled by ridesharing in the points, for example.

For example, when the ratio of the distance of the driving section with respect to the total travel distance is high, the support server 300 can relatively increase the points to be given to the driver who drove the driving section. Further, when the ratio of the distance of the driving section with respect to the total travel distance is low, the support server 300 can relatively decrease the points to be given to the driver who drove the driving section. In the present embodiment, the driving points corresponding to the passage information such as the running distance of the driver who drove the vehicle 10 can be given as incentives.

Next, processing of FIG. 16 will be described. FIG. 16 is a flowchart illustrating an example of calculation processing of the points according to the running time of the driving section. Through the processing of FIG. 16, the points according to the running time of the driver who drove the vehicle 10 are calculated. The processing of FIG. 16 is executed for each of the persons on board (planned driver, fellow passenger) registered in the reservation information with the reservation ID.

Figure 16:
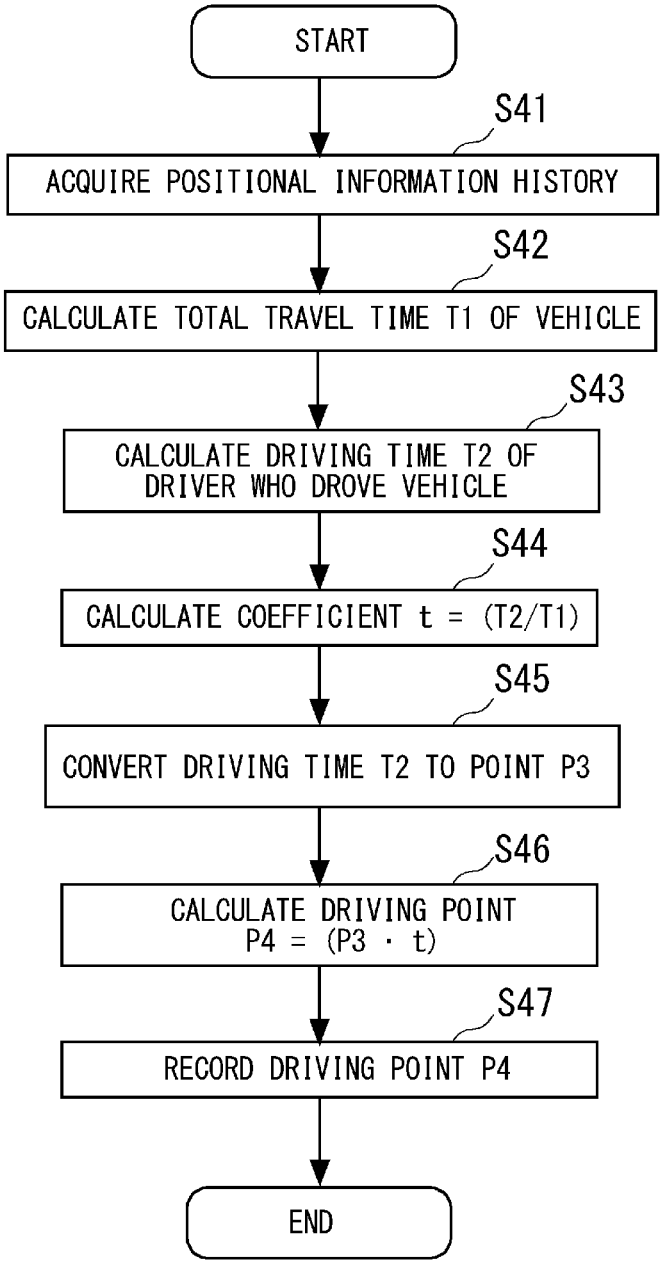
FIG. 16 is a flowchart illustrating an example of calculation processing of points according to running time of a driving section.

In the flowchart of FIG. 16, the start of processing is similar to the case of FIG. 15. The support server 300 identifies the route traveling information table corresponding to the reservation ID registered in the ridesharing management DB 38 based on the reservation ID notified from the onboard apparatus 100. Then, the support server 300 acquires the positional information history from the identified route traveling information table (S41).

In processing of S42, the support server 300 calculates total travel time T1 from the departure point of the vehicle 10 until reaching the destination point based on the time information of the acquired positional information history. The support server 300 extracts the time information at a recording start time of the positional information history and the time information at a recording end point of the positional information history, for example, and calculates the total travel time T1 from a difference between the time information at the recording end point and the time information at the recording start point. Through the processing of S42, the total driving time of the vehicle 10 for ridesharing registered with the reservation ID is identified. The calculated total travel time T1 is forwarded to processing of S44.

In processing of S43, the support server 300 calculates running time T2 of the vehicle 10 driven by the person on board as the processing target. The support server 300 extracts the positional information history corresponding to the person on board as the processing target based on the ID of the driver recorded in the history of the positional information, for example. Then, the support server 300 calculates the running time T2 of the vehicle 10 driven by the person on board from the time information at the recording start point of the extracted positional information history and the time information of the recording end point in a similar manner to the processing of S42. Note that when there are plurality of recorded parts of the ID corresponding to the processing target existing in the positional information history, the running time for each of such parts may be calculated and added to acquire the running time T2 of the processing target. Through the processing of S43, the running time (driving time of the processing target) corresponding to the ID of the driver recorded in the history of the positional information is calculated. The calculated running time T2 is forwarded to the processing of S44.

In the processing of S44, the support server 300 calculates "coefficient t=(T2/T1)" based on the forwarded total travel time T1 and running time T2. Through the processing of S44, the coefficient t indicating a ratio of the driving time of the processing target with respect to the total travel time of ridesharing is calculated. The calculated coefficient t is forwarded to processing of S46.

In processing of S45, the support server 300 converts the running time T2 of the processing target to a point P3. The support server 300 converts the running time T2 to the point by using a point conversion coefficient per unit time defined in advance, for example. For example, in a case where 1 point is given with 1 minute taken as a unit time, the running time T2 of 30 minutes is converted to 30 points. Through the processing of S45, the points corresponding to the running time spent for traveling in ridesharing by driving of the processing target are calculated. The calculated point P3 is forwarded to the processing of S46.

In the processing of S46, the support server 300 calculates "a driving point P4=(P3×t)" by multiplying the forwarded point P3 and coefficient t. Through the processing of S46, the driving point allotted according to the ratio of the running time driven by the processing target with respect to the total travel time from the departure point to the destination point is calculated. The support server 300 records the calculated driving point P4 in the ridesharing management DB 38 (S47). The driving point P4 is stored in the running time sub-field of the point management information table. After the processing of S47, the processing of FIG. 16 is ended.

Through the above processing, the support server 300 can identify the travel time from the departure point of the vehicle 10 to the destination point via the riding point and the alighting point of the fellow passenger based on the history of the positional information notified from the onboard apparatus 100. Then, the support server 300 can identify the driving time for each of the processing targets based on the time information and the identification information (ID) for identifying the driver recorded in the history of the positional information. The support server 300 can identify the passage information for the driver at the start of running of the vehicle 10 traveled by ridesharing and for each of the drivers changed after the start of running. Note that the identification information (ID) for identifying the driver recorded in the history of the positional information is the information for identifying the planned driver or the fellow passenger registered in the reservation information with the reservation ID.

Further, the support server 300 can calculate the running time of the vehicle 10 driven by the driver and calculate the points corresponding to the running time. The support server 300 can calculate the driving points for each of the drivers by reflecting the ratio of the running time driven by the driver with respect to the total travel time from the departure point to the destination point of the vehicle 10 traveled by ridesharing in the points, for example.

For example, when the ratio of the running time is high with respect to the total travel time, the support server 300 can relatively increase the points to be given to the driver. Further, when the ratio of the running time with respect to the total travel time is low, the support server 300 can relatively decrease the points to be given to the driver. In the present embodiment, the driving points corresponding to the passage information such as the running time of the driver driving the vehicle 10 can be given as incentives.

Figure 17:
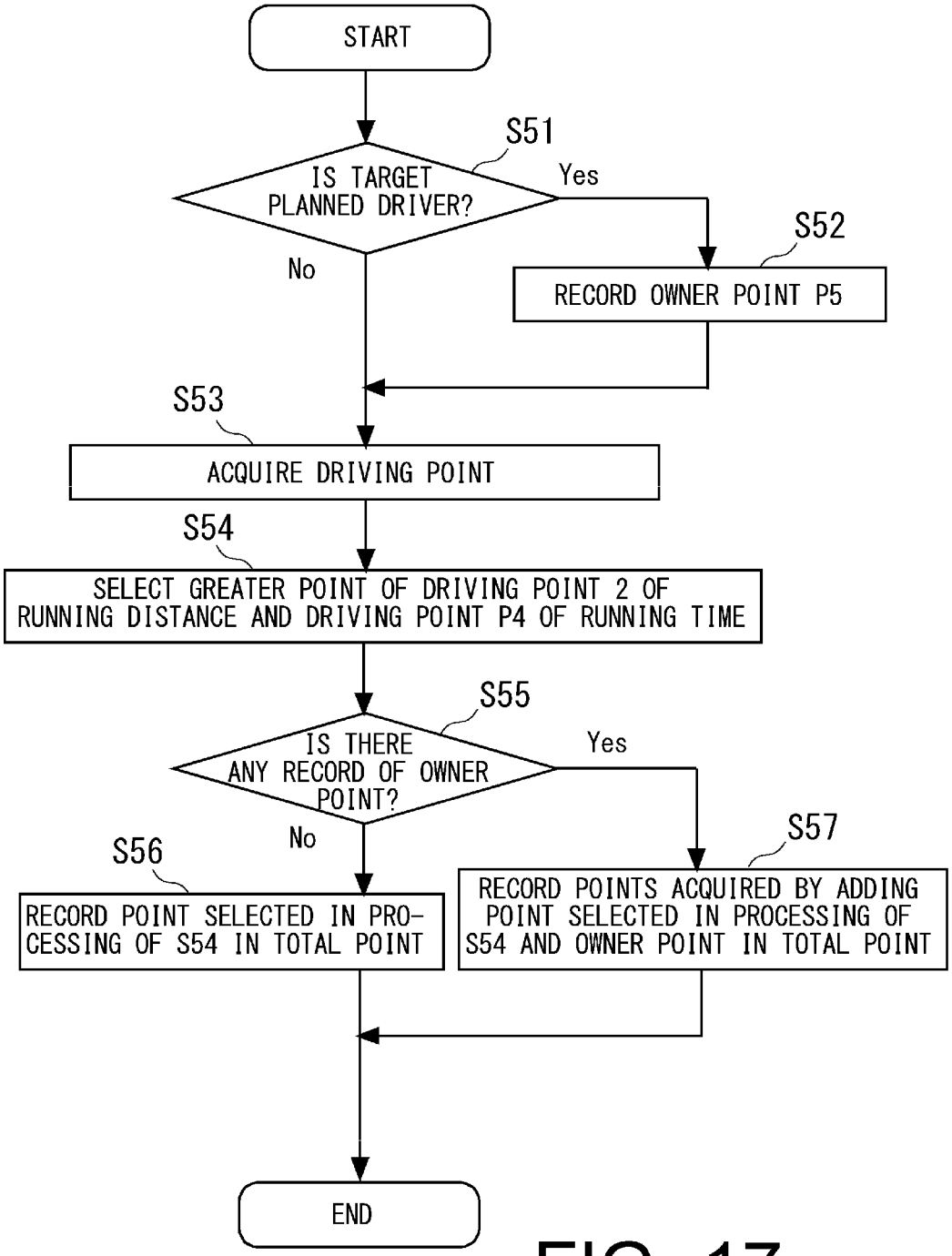
FIG. 17 is a flowchart illustrating an example of calculation processing of points given to the driver.

Next, the processing of FIG. 17 will be described. FIG. 17 is a flowchart illustrating an example of calculation processing of the points to be given to the driver. Through the processing of FIG. 17, total point of the driver based on the passage information at the time of traveling on the route by ridesharing are calculated. The processing of FIG. 17 is executed for each of the persons on board (planned driver, fellow passenger) registered in the reservation information with the reservation ID. Note that the processing of FIG. 17 is an example of the processing executed for calculating the total points based on the owner points and the driving points stored in the point management information table described in FIG. 7.

In the flowchart of FIG. 17, the start of the processing is similar to the case of FIG. 15. The support server 300 searches the ridesharing management DB 38 by using the reservation ID included in a point calculation request from the onboard apparatus 100 as a search key to identify the point management information table corresponding to the reservation ID. The support server 300 determines whether or not the processing target is the planned driver based on the ID information stored in the persons on board field (S51). When the processing target is the planned driver ("Yes" in S51), the support server 300 shifts to processing of S52. In the meantime, when the processing target is not the planned driver ("No" in S51), the support server 300 shifts to processing of S53.

In the processing of S52, the support server 300 records an owner point P5 (fixed point defined in advance) to be given to the planned driver in the owner point field of the point management information table. Through the processing of S52, the points for the provider of the vehicle can be given to the planned driver as the provider of the vehicle 10 used for ridesharing. The processing shifts to S53.

In the processing of S53, the support server 300 acquires the driving points given to the processing target. Through the processing of S53, the driving points calculated based on the passage information can be acquired for the processing target who takes part in driving in ridesharing. The support server 300 acquires the driving point P2 stored in the running distance sub-field and the driving point P4 stored in the running time sub-field of the point management information table, for example, and shifts to processing of S54.

In the processing of S54, the support server 300 selects the greater point out of the driving point P2 regarding the running distance and the driving point P4 regarding the running time. Then, the support server 300 determines whether or not the owner point P5 is stored in the owner point field of the processing target (S55). When the owner point P5 is stored in the owner point field of the processing target ("Yes" in S55), the support server 300 shifts to processing of S57. In the meantime, when the owner point P5 is not stored in the owner point field of the processing target ("No" in S55), the support server 300 shifts to processing of S56.

In the processing of S56, the support server 300 stores the driving point selected in the processing of S54 in the total point field of the point management information table. Through the processing of S56, the points are given to the driver (fellow passenger) other than the planned driver at the time of traveling on the route. After the processing of S56, the processing of FIG. 17 is ended.

In the processing of S57, the support server 300 stores the points acquired by adding the driving point selected in the processing of S54 and the owner points in the total point field of the point management information table. Through the processing of S57, the points are given to the planned driver by taking the points for the provider of the vehicle 10 used for ridesharing into consideration. After the processing of S57, the processing of FIG. 17 is ended.

Through the above processing, the support server 300 can give the points to the driver who drove the vehicle 10 by reflecting the passage information at the time of traveling in the route. Further, the support server 300 can increase the points to be given to the provider of the vehicle 10 used for traveling by ridesharing. With the present embodiment, it is possible to calculate the points for the driver by reflecting the passage information of traveling by ridesharing and providing of the vehicle 10 to be used for ridesharing. Willingness to participate in ridesharing can be increased by giving incentives to the driver who drives the vehicle in accordance with providing of the vehicle 10 and the passage information regarding driving.

<First Modification>

Figure 18:
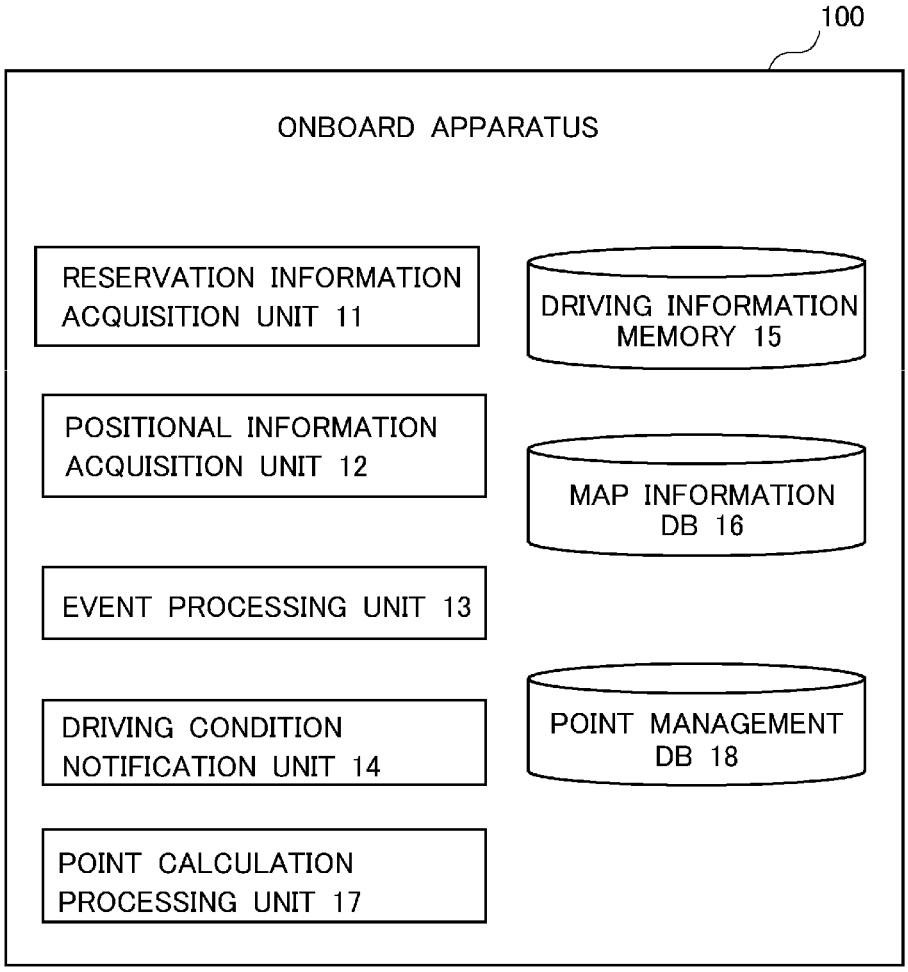
FIG. 18 is a diagram illustrating an example of a functional configuration of an onboard apparatus according to a first modification.

In the first modification, the onboard apparatus 100 can have a point processing function of the support server 300 according to the first embodiment. For example, as illustrated in FIG. 18, the onboard apparatus 100 according to the first modification can include a point calculation processing unit 17 and a point management DB 18 in the functional configuration. The point calculation processing unit 17 corresponds to the point processing unit 33 of the support server 300 of the first embodiment, and calculates the points to be given to the driver of the vehicle 10 based on the history of the positional information described in the flowcharts of FIG. 15 to FIG. 17. Further, the point management DB 18 corresponds to the ridesharing management DB 38 of the support server 300 of the first embodiment, and the route traveling information table described in FIG. 6 and the point management information table described in FIG. 8 are stored therein.

The point calculation processing unit 17 of the first modification calculates the running distance and the running time of each of the drivers based on the positional information history acquired by the positional information detection unit 107, for example. The point calculation processing unit 17 executes the processing of FIG. 15 to FIG. 16 based on the calculated running distance and the running time of each of the drivers, and records the driving points. The point calculation processing unit 17 may execute the processing of FIG. 17 based on the point management information table stored in the point management DB 18, for example, and calculate the total point by reflecting the passage information traveled by ridesharing and providing of the vehicle 10 used for ridesharing. With the onboard apparatus 100 of the first modification, it is also possible to increase the willingness to participate in ridesharing by giving incentives to the driver who drives the vehicle in accordance with providing of the vehicle 10 and the passage information regarding driving.

<Second Modification>

In the second modification, the onboard apparatus 100 can notify the history of the positional information recorded in the driving information memory 15 to the support server 300 irrespective of the event such as change of the driver. For example, the onboard apparatus 100 can notify to the support server 300 the history of the positional information recorded in the driving information memory 15 at a prescribed time interval such as 10 minutes or a prescribed distance unit such as 10 km. Further, the onboard apparatus 100 may notify the positional information described in FIG. 9 to FIG. 14 to the support server 300 via the communication unit 106A at a timing of acquisition. In the second modification, the onboard apparatus 100 can notify the acquired positional information to the support server 300 by associating it with the time information and the ID or the like of the driver without using the driving information memory 15.

<Other Embodiments>

The above-described embodiments are simply examples, and the disclosure of the embodiments can be implemented by adding changes as appropriate within a spirit and a scope thereof. The processing and means described in the present disclosure can be implemented in combination in a flexible manner as long as there is no technical confliction.

Further, the processing described to be performed by a single device may be allotted and executed by a plurality of devices. Also, the processing described to be performed by different devices may be executed by a single device. In a computer system, it is possible to flexibly change the hardware configuration (server configuration) for implementing each function.

Programs causing an information processing apparatus or another machine or device (hereinafter, referred to as a computer or the like) to implement any of the above-described functions can be recorded in a recording medium that can be read by the computer or the like. Such functions can be provided by having the computer or the like read out and execute the programs in the recording medium.

Note here that the recording medium that can be read by the computer or the like is a recording medium that accumulates information such as data, programs, or the like by electrical, magnetic, optical, mechanical, or chemical action, and allows the computer or the like to read out. Examples of such recording medium that can be removed from the computer or the like may be a flexible disk, a magneto-optical disk, a CD-ROM, a CD-R/W, a DVD, a Blu-ray Disc, a DAT, 8-mm tape, and a memory card such as a flash memory. Further, examples of the recording medium fixed to the computer or the like may be a hard disk and a ROM.

What is claimed is:

1. An onboard apparatus provided inside a vehicle comprising:

a communication unit; and a controller configured to execute:

detecting start of running of the vehicle provided for sharing a ride, detecting a driver at the start of running, detecting change of the driver after the start of running, and measuring passage information including at least one of running time and running distance from the start of running until the change of the driver, and transmitting the measured passage information to an information processing apparatus that calculates points based on at least the measured passage information, which is an amount of driving load recorded from the start of running until the change of the driver, via the communication unit along with identification information for identifying the driver detected before the change of the driver.

2. The onboard apparatus according to claim 1, wherein the controller is configured to further execute:

upon detecting the change to a next driver, recording the identification information for identifying the driver before the change to the next driver is detected, along with the passage information measured for the driver before the change in a recording unit; and upon detecting end of running of the vehicle by sharing the ride, transmitting the identification information for identifying each of the drivers recorded between the start of running of the vehicle by sharing the ride to the end and the passage information recorded for each of the drivers to the information processing apparatus via the communication unit.

3. An information processing apparatus comprising:

a communication unit; and a controller configured to execute:

via the communication unit, receiving identification information for identifying each of drivers recorded between start of running of a vehicle by sharing a ride to end and passage information recorded for each of the drivers, the passage information recorded for each of the drivers being an amount of driving load recorded for each of the drivers; and calculating points for each of the drivers based on (i) the identification information of each of the drivers and (ii) the passage information recorded for each of the drivers which is the amount of driving load recorded for each of the drivers.

4. The information processing apparatus according to claim 3, wherein the points are calculated based on a running time and a running distance recorded for each of the drivers.

5. The information processing apparatus according to claim 3, wherein, in calculating the points for each of the drivers, the controller determines whether a respective driver is a provider of the vehicle, and increases the points for the respective driver by a predefined amount upon determining that the respective driver is the provider of the vehicle.

6. An information processing method executed by a computer including a communication unit, comprising steps of:

receiving, via the communication unit, identification information for identifying each of drivers recorded between start of running of a vehicle by sharing a ride to end and passage information recorded for each of the drivers, the passage information recorded for each of the drivers being an amount of driving load recorded for each of the drivers; and calculating points for each of the drivers based on (i) the identification information of each of the drivers and (ii) the passage information recorded for each of the drivers which is the amount of driving load recorded for each of the drivers.

7. A non-transitory computer readable storage medium recording a computer program for causing a computer including a communication unit to perform steps of:

receiving, via the communication unit, identification information for identifying each of drivers recorded between start of running of a vehicle by sharing a ride to end and passage information recorded for each of the drivers, the passage information recorded for each of the drivers being an amount of driving load recorded for each of the drivers; and calculating points for each of the drivers based on (i) the identification information of each of the drivers and (ii) the passage information recorded for each of the drivers which is the amount of driving load recorded for each of the drivers.

* * * * *